US011820542B2

(12) United States Patent
Langen et al.

(10) Patent No.: US 11,820,542 B2
(45) **Date of Patent: *Nov. 21, 2023**

(54) METHOD AND APPARATUS FOR RECONFIGURING CONTAINERS

(71) Applicant: AFA SYSTEMS LTD., Brampton (CA)

(72) Inventors: H. J. Paul Langen, Brampton (CA); Ryan Radu, Mississauga (CA)

(73) Assignee: AFA SYSTEMS LTD., Brampton (CA)

( * ) Notice: Subject to any disclaimer, the term of this patent is extended or adjusted under 35 U.S.C. 154(b) by 280 days.

This patent is subject to a terminal disclaimer.

(21) Appl. No.: 17/084,047

(22) Filed: Oct. 29, 2020

(65) Prior Publication Data

US 2021/0039816 A1 Feb. 11, 2021

Related U.S. Application Data

(63) Continuation of application No. 15/970,477, filed on May 3, 2018, now Pat. No. 10,850,881.

(Continued)

(51) Int. Cl.

| | |
|---|---|
| ***B31B 50/00*** | (2017.01) |
| ***B31B 50/06*** | (2017.01) |
| ***B31B 50/52*** | (2017.01) |
| ***B65B 43/30*** | (2006.01) |
| ***B65H 5/10*** | (2006.01) |
| ***B31B 50/02*** | (2017.01) |

(Continued)

(52) U.S. Cl.

CPC ..... *B65B 43/305* (2013.01); *B31B 50/022* (2017.08); *B31B 50/804* (2017.08); *B65B 43/145* (2013.01); *B65B 43/185* (2013.01); *B65H 3/085* (2013.01); *B65H 3/0883* (2013.01); *B65H 3/42* (2013.01); *B65H 5/10* (2013.01); *B31B 50/024* (2017.08); *B31B 50/046* (2017.08); *B31B 50/062* (2017.08); *B31B 2100/00* (2017.08); *B31B 2120/30* (2017.08); *B65H 2701/1766* (2013.01)

(58) Field of Classification Search

CPC ..... B31B 50/062; B31B 50/804; B31B 50/00; B31B 50/06; B31B 50/52; B65G 9/06; B65G 9/061; B65G 9/062; B65G 9/066

USPC ..... 414/795.4, 797.7, 797.8; 493/309

See application file for complete search history.

(56) References Cited

U.S. PATENT DOCUMENTS 2,762,274 A * 9/1956 Kerr ..... 493/181
2,887,022 A * 5/1959 Lubersky ..... B31B 50/00 493/124

(Continued)

*Primary Examiner* — Praachi M Pathak

(57) ABSTRACT

Methods and apparatus for forming containers from container blanks are provided. An apparatus comprises a blank holding apparatus operable to releasably hold a plurality of carton blanks in a first configuration. The apparatus also has a rotary apparatus operable to rotate an engagement device along a rotational path from a first retrieval location where the engagement device is operable to engage with and retrieve a blank from the plurality of blanks held in the blank holding apparatus, to a second operational location. The apparatus also has a movement apparatus inter-connected to the rotary apparatus. The movement apparatus is operable to move the rotary apparatus and the engagement device with the engaged blank away from the blank holding apparatus, which may be translational movement away from the blank holding apparatus.

17 Claims, 16 Drawing Sheets

Related U.S. Application Data

(60) Provisional application No. 62/501,562, filed on May 4, 2017.

(51) Int. Cl.

| | |
|---|---|
| ***B31B 50/80*** | (2017.01) |
| ***B65H 3/08*** | (2006.01) |
| ***B65H 3/42*** | (2006.01) |
| ***B65B 43/18*** | (2006.01) |
| ***B65B 43/14*** | (2006.01) |
| *B31B 120/30* | (2017.01) |
| *B31B 100/00* | (2017.01) |
| *B31B 50/04* | (2017.01) |

(56) References Cited

U.S. PATENT DOCUMENTS 3,633,470 A * 1/1972 Bingham ..... B65B 43/185 493/310
3,937,458 A 2/1976 Langen
4,531,931 A * 7/1985 Dietrich ..... B65B 43/185 493/309
4,537,587 A 8/1985 Langen
4,629,446 A * 12/1986 Focke ..... B31B 50/00 271/91
4,735,600 A * 4/1988 Drewke ..... B65B 43/185 493/314
5,061,231 A * 10/1991 Dietrich ..... B65B 43/185 271/95
5,176,612 A * 1/1993 Calvert ..... B65H 3/0883 493/315
5,298,008 A * 3/1994 Decker ..... B31B 50/80 493/313
5,456,570 A * 10/1995 Davis, Jr. ..... B65G 47/915 271/107
5,473,868 A * 12/1995 Antonio ..... B65B 43/345 493/309
5,910,078 A 6/1999 Guttinger et al.
6,240,707 B1 * 6/2001 Ford ..... B65B 43/305 493/315
6,474,635 B2 * 11/2002 Ruf ..... B65H 3/0808 271/107
6,699,165 B1 * 3/2004 Krieger ..... B65B 43/185 493/122
7,695,421 B2 * 4/2010 Ford ..... B65B 43/185 271/100
8,277,367 B2 * 10/2012 Jannin ..... B65B 43/305 493/374
82,777,367 10/2012 Jannin et al.
9,821,526 B2 * 11/2017 Cavazza ..... B65B 43/185
2007/0072756 A1 * 3/2007 Monti ..... B65B 5/024 493/309
2008/0300123 A1 * 12/2008 Bonnain ..... B65B 43/265 493/310
2009/0264269 A1 * 10/2009 Monti ..... B65B 43/265 493/52
2013/0186043 A1 * 7/2013 Monti ..... B65B 43/285 53/381.1
2013/0199135 A1 * 8/2013 Monti ..... B65B 43/285 53/564

* cited by examiner

METHOD AND APPARATUS FOR RECONFIGURING CONTAINERS

CROSS-REFERENCE TO RELATED APPLICATIONS

This application is a Continuation of U.S. patent application Ser. No. 15/970,477 filed on May 3, 2018 and which claimed the priority benefit of U.S. Provisional Patent Application Ser. No. 62/501,562 filed on May 4, 2017. The contents of the aforementioned applications are incorporated herein in their entirety.

FIELD

This disclosure generally relates to methods and apparatus for reconfiguring containers from a first configuration such as a storage configuration to a second configuration such as an erected configuration. Such methods and apparatus may be employed as part of a container packaging system.

BACKGROUND

Containers are used to package many different kinds of items. One form of container used in the packaging industry, generically referred to as a "box", can be used to hold various items including products and sometimes other boxes containing products. Some in the packaging industry refer to boxes used to package one or more products as "cartons". In the industry, there are also containers/boxes that are known by some as "cases". Examples of cases include what are known as a regular slotted case (also referred to as an "RSC").

In this patent document, including the claims, the words "carton", "cartons", "container", "containers" are used collectively and interchangeably to refer to boxes, cartons, trays, containers and/or cases that can be used to package any type of items including products and other cartons/containers.

Cartons come in many different shapes and sizes and can be made from a wide variety of materials. However, many cartons are foldable and are "formed" when they are erected from a first configuration (eg. a flattened state) commonly referred to as a "carton blank"—to a second configuration (eg. an expanded state). Cartons may be made from an assortment of foldable materials, including but not limited to cardboard, chipboard, paperboard, corrugated fibreboard, other types of corrugated materials, plastic materials, composite materials, and the like and possibly even combinations thereof.

In many known systems, carton blanks may be serially retrieved from a carton magazine, reconfigured from a flattened state into an erected state, and placed in a slot on a carton conveyor. The erected carton may then be moved by the carton conveyor to a loading station where the carton may be filled with one or more items. The loaded carton may thereafter be sealed and/or otherwise closed.

To permit carton blanks to be readily configured for use, such as by reconfiguring them from a storage configuration to an erected configuration, blanks may be held in a storage magazine in a generally completely flattened configuration. An apparatus may be provided to manipulate the blanks such that are folded into a particular erected configuration and sealed to form an erected carton. The sealing process typically involves gluing or taping panels and or flaps/together, and specialized apparatus that handle such flat, unfolded and unsealed carton blanks are known.

Some blanks are provided to users not in a flat, unfolded and unsealed configuration, but rather in what is known as a "knock-down" configuration. Blanks in a knock-down configuration are often referred to as "KD" blanks. KD blanks may take partially folded storage configurations, and they may be partially glued or otherwise sealed along one or more seams (typically along one side seam). As such, KD blanks in a storage configuration typically have generally flattened tubular shapes. Accordingly, the erection of a KD blank may require pulling apart generally opposed panels of the blank (such as wall panels) to reconfigure the blank from a generally flattened tubular configuration to an open tubular configuration. The open tubular configuration, or "erect carton", may then be suitable for delivery to a carton conveyor for loading/filling and sealing/closing.

After being placed on a carton conveyor, an erect carton may have one end closed by folding and sealing the bottom flaps, so that it can be filled from the opposite end while on the carton conveyor. Any required additional flap folding and sealing, such as for example with glue or tape, can be carried out to close and seal the carton with one or more items contained therein. Alternately, for example the erect carton may be reoriented from a side orientation to an upright orientation with an upward-facing opening and a sealed bottom face. The erect carton may then be moved to a loading station/loading system where it may be top loaded with one or more items. The upward-facing opening may then be closed by folding over and sealing the top flaps.

It is well known that carrying out these types of operations under typical industrial conditions involves machinery which is quite complex. For example, the erection of a KD blank into an erected carton is typically done with an apparatus referred to as a "carton erector" or "carton feeder". In this patent application, the terms "carton erector" and "carton feeder" are used interchangeably. Carton feeders can be configured to serially retrieve KD blanks from a stack of KD blanks held in a magazine, open them up into erect cartons, and place the erect cartons on a carton conveyor. Carton feeders may use suction cups that employ a suction force to engage and hold the KD blanks. The suction cups are typically mounted on a rotary transfer apparatus and the carton feeder may be configured to move the KD blanks/cartons along a rotational path that is generally arcuate, and which may be cyclical, between the various locations for retrieval, opening and release of an erected carton.

These operations may be executed at high speed and with a high degree of precision in order to provide a reliable and efficient carton feeding process. However, difficulties can arise in designing components that can achieve a clean retrieval, rotation and release by the carton feeder. For example, during retrieval of blanks from a magazine, rotation of the rotary transfer apparatus may result in retrieved KD blanks held by one or more suction cups making contact with one or more of the stack of blanks, the magazine, and the support frame. Undesirable contact may reduce the precision of the retrieval operation, and may lead to issues—especially when the KD blanks/cartons are large and/or are rigid/semi-rigid. For example, the contact may result in the KD blank becoming improperly oriented while being held by the suction cups, with potential problems in the opening of the KD blank and/or its proper placement on a carton conveyor.

Accordingly, an improved system for retrieving a KD blanks, erecting them into cartons and releasing the cartons for further processing is desirable.

SUMMARY

In one aspect, the present disclosure relates to an apparatus the comprises a blank holding apparatus operable to releasably hold a plurality of carton blanks in a first configuration; a rotary apparatus operable to rotate an engagement device along a rotational path from a first retrieval location where the engagement device is operable to engage with and retrieve a blank from the plurality of blanks held in said blank holding apparatus, to a second operational location; and a movement apparatus inter-connected to said rotary apparatus, said movement apparatus operable to move the rotary apparatus and the engagement device with said engaged blank away from the blank holding apparatus.

In another aspect, the present disclosure relates to an apparatus that comprises a magazine for containing a plurality of flattened tubular container blanks; a rotary apparatus operable to rotate an engagement device along a cyclical rotational path between an on-loading location where the engagement device engages a blank from the plurality of flattened tubular container blanks, an operation location where the blank is at least partially erected into a container, and an off-loading location where the engagement device releases the container; and a slide apparatus comprising a slide assembly on which the rotary apparatus is mounted, the slide apparatus operable to translate the rotary apparatus from a first translational position where said engagement device can engage a blank, to a second translational position away from the magazine to allow the engagement element to traverse the rotational path without causing the blank to contact the plurality of flattened tubular container blanks, and then after the container is released, to translate the rotary apparatus back to the first translational position.

In another aspect, the present disclosure relates to a method of retrieving a blank from a plurality of blanks that comprises rotating an engagement device of a rotary apparatus along a rotational path to a first retrieval location; retrieving a blank from the plurality of blanks with the engagement device; moving the rotary apparatus including the engagement device with the engaged blank away from the plurality of blanks; and rotating the rotary apparatus including the engagement device with the engaged blank to a second operational location.

In another aspect, the present disclosure relates to a method of erecting a flattened tubular container blank into a container, the method comprises retrieving a blank from a plurality of flattened tubular container blanks, at an on-loading position, by engaging the blank with an engagement device which is connected to a rotary member which is mounted on a slide frame; translating the slide frame to bring the rotary member, the engagement element and the blank a distance away from the plurality of flattened tubular container blanks; rotating the rotary member to bring the blank into an operation location and at least partially erecting the blank into a container; and releasing the container from the engagement element at an off-loading location.

Other aspects and features will become apparent, to those ordinarily skilled in the art, upon review of the following description of the specific illustrative embodiments.

BRIEF DESCRIPTION OF THE DRAWINGS

Non-limiting embodiments are described in detail below, with reference to the following drawings.

DETAILED DESCRIPTION

Figure 1A:
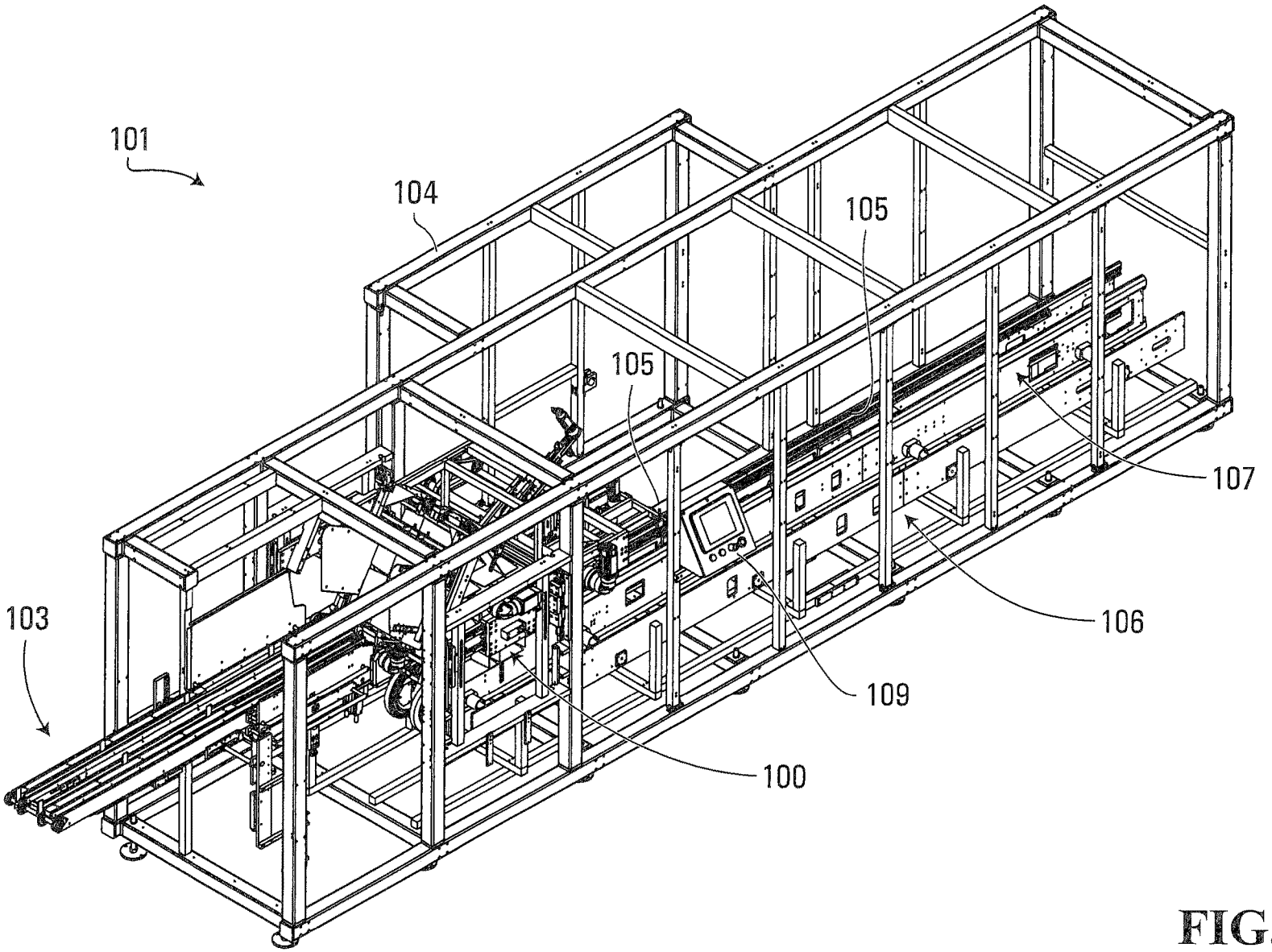
FIG. 1A is a perspective view of part of a carton packing system which includes a carton feeder in accordance with an embodiment.

With reference initially to FIG. 1A, an example carton packaging system 101 is illustrated which may include a blank infeed conveyor sub-system 103; a carton feeder 100; a main support frame 104; a carton conveyor 105; a carton filling/loading sub-system 106; and a carton closing sub-system 107. The components of carton packaging system 101 may be controlled by a controller generally designated 109 that may include an HMI screen. Controller may for example be a model 1000 controller made by Allen Bradley.

Suitable power sources such as electrical power sources may be provided to supply power to components of system 101, including components of carton feeder 100, such as PLC 109 and the various motors, servo drive motors, valves and sensors as described herein.

Carton feeder 100 may be operable to: (i) retrieve flattened tubular carton blanks 200 (hereinafter referred to as KD blanks 200 from a stack 210 of blanks, (ii) erect them into an at least partially erect cartons 220; and (iii) release the cartons 220 for further processing/handling.

Figure 1B:
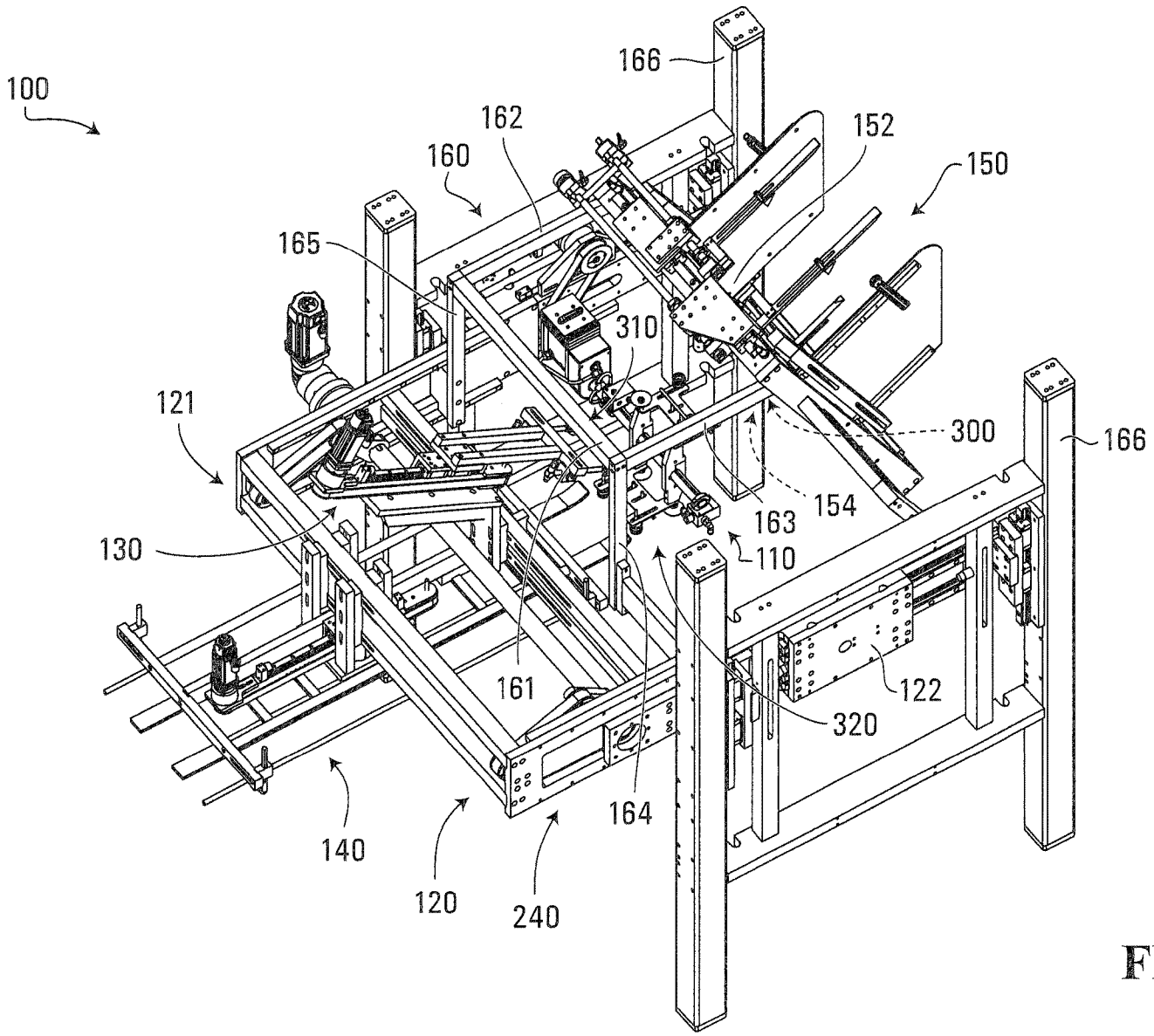
FIG. 1B is a perspective view of part of the system of FIG. 1A showing components of a carton feeder in isolation.
Figure 1D:
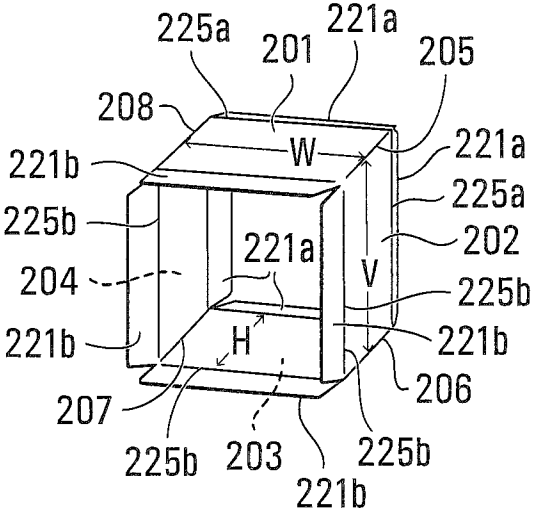
FIG. 1D is a perspective view of the carton of FIG. 1C in an erected configuration.
Figure 1C:
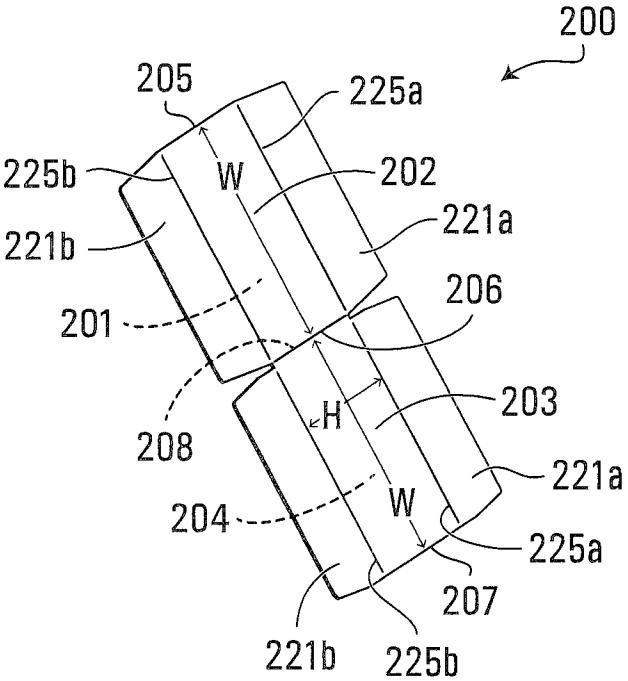
FIG. 1C is a perspective view of a knock down type carton in a flattened configuration.

With reference to FIGS. 1C and 1D, each KD blank 200 may be formed with oppositely disposed minor side wall panels 201 and 203 which may be connected to major side wall panels 202 and 204 along hinges 205, 206, 207 and 208. Prior to being erected into carton 220, KD blank 200 may be folded along hinge lines 206 and 208 with main panel 201 and side panel 202 being disposed on opposite sides of hinge line 205 and main panel 203 and side panel 204 being disposed on opposite sides of hinge 207 such that the KD blank is in a generally flattened configuration. In this configuration, minor side wall panel 201 and major side all panel 204 may be generally disposed in a face-to-face relationship, as may be minor side wall panel 203 and major side wall panel 202. Each of minor side wall panels 201, 203 and major side wall panels 202, 204 may have upper flaps 221*a* and lower flaps 221*b* that may be connected to their respective side wall panels along hinge lines.

KD blanks 200 may be made of a variety of materials such as cardboard, chipboard, paperboard, corrugated fibreboard, other types of corrugated materials, plastic materials, composite materials, and the like and possibly even combinations thereof. KD blanks 200 may be of any particular shape and may have any particular dimensions. By way of example only, KD blanks 200 when erected may form generally cuboid shaped cartons and may typically have width dimensions W and height dimensions H. When held in a blank holding apparatus 150 (see FIG. 1A), each KD blank in a flattened configuration may have a total length of 2×W (see FIG. 1C). It will be appreciated that this length may be quite significant in relation to the dimensions of the components of carton feeder 100 and their relative positioning to each other.

With reference to FIG. 1B, carton feeder 100 may comprise blank holding apparatus 150, a carton opening apparatus 130, a rotary transfer apparatus 110 and a hold-down apparatus 140. A sub-frame 160, which may be part of main support frame 104, may support one or more of the components of carton feeder 100. For example, blank holding apparatus 150 may be fixedly attached to and supported by sub-frame 160. Holding apparatus 150 may be configured to hold a stack of blanks 210 that may be comprised of a plurality of KD blanks 200. By way of example only, stack 210 of KD blanks 200 may comprise between 50 and 80 KD blanks 200.

Carton feeder 100 may also comprise a translational movement mechanism 240 which may include a sliding apparatus 120. Sliding apparatus may be operable to move the rotary transfer apparatus 110 such as with translational movement, relative to the blank holding apparatus 150. Sliding apparatus 120 may include a slide assembly 121. Components of slide assembly 121 may each be made from one or more suitable materials such as for example steel or stainless steel.

Slide apparatus 120 may also include rail members 124*a*, 124*b* mounted to a respective support plate 199*a*, 199*b* (FIGS. 4, 5 and 6) that may both be fixedly inter-connected to sub-frame 160 in transverse spaced relation to each other. In some embodiments, the support plates 199*a*, 199*b* may be mounted to vertical rails and be movable by hydraulic cylinders controlled by PLC 109, between different vertical positions. Thus slide apparatus 120 may be movable between different vertical positions to accommodate different sized KD blanks 220 being held in blank holding apparatus 150. This may assist with the changeover of carton feeder 100 to process a variety of different sized KD blanks 200.

Sliding apparatus 120 may be configured to be able to move sliding assembly 121 with sliding, reciprocating, translational movement relative to sub-frame 160 on rails 124*a*, 124*b*. Rotary transfer apparatus 110 may be mounted to and supported on sliding assembly 121 for sliding, reciprocating, translational movement with sliding assembly 121 towards and away from blank holding apparatus 150. Components of sliding apparatus 120 such as sliding assembly 121 may be configured to move with reciprocating translational movement relative to sub-frame 160 such that rotary transfer apparatus 110 may be moved in translational movement between a first position which is proximate to storage apparatus 150 (i.e. at a blank retrieval location 300) and a second position which is at an increased distance from blank holding apparatus 150.

Rotary transfer apparatus 110 may have at least one engagement device such as pairs of engagement elements 116*a*, 116*b* (eg. a suction cup) that may be movable along a path, as described further below. In carton feeder 100, rotary transfer apparatus 110 has one pair of spaced engagement elements 116*a* oriented in one direction a second pair of spaced engagement elements 116*b* oriented in an opposite direction such that they are oriented at an angle 180 degrees apart.

In overview, rotary transfer apparatus 110 and slide apparatus 120 may provide a mechanism for enabling pairs of engagement elements 116*a*, 116*b* of rotary transfer apparatus 110 to: (i) successively and serially engage and retrieve KD blanks 200 from storage apparatus 150, (ii) translate each KD blank 200 in turn away from blank holding apparatus 150; and (iii) rotate each blank along a rotational path.

In various embodiments, translational movement of the rotary transfer apparatus 110 with engagement elements 116*a*, 116*b* with the KD blank 200 engaged by the engagement elements 116*a*, 116*b*, away from the engagement location proximate storage apparatus 150, may occur at the same time as, during, or prior to commencing, rotation of the KD blank by rotary transfer apparatus 110 on a rotational path away from storage apparatus 150. This translational movement may minimize or eliminate unwanted contact between KD blank 200 and one or more of stack 210, blank holding apparatus 150, and sub-frame 160.

Rotation of rotary transfer apparatus 110 may also be operable to move engagement elements 116*a*, 116*b* thereof, and each KD blank 200 secured to the engagement elements, on rotational paths from the engagement location proximate the blank storage apparatus 150, to a carton opening location 310 which is proximate to carton opening apparatus 130. In the carton opening location, KD blank 200 may be at least partially opened into an erected carton 220 with the assistance of carton opening apparatus 130. Further rotation by rotary transfer apparatus 110 of engagement elements 116*a*, 116*b* on their rotational paths may bring each KD blank 220 (at least partially erected) into a release location 320 which is proximate to hold-down apparatus 140. At the release location, the KD blank 200 may be reconfigured to its fully erect configuration. This may occur by engagement of the KD blank 200 with a wall of a bucket/slot on carton conveyor 105. Hold-down apparatus 140 may be operable to stabilize carton 220 as it is released and positioned by engagement elements 116*a*, 116*b* of rotary transfer apparatus 110 in a bucket/slot of carton conveyor 205. Rotary transfer apparatus 110 and engagement elements 116*a*, 116*b*, in combination with hold-down apparatus 140, may co-operate to hold erected carton of KD blank 220 in a bucket/slot on carton conveyor 105.

Once the erected carton 220 has been released from hold down apparatus 140, slide apparatus 120 may move rotary transfer apparatus 110 and its engagement elements 116*a*, 116*b* in translational movement back towards blank holding apparatus 150 to permit the rotation of rotary transfer apparatus 110 and engagement elements 116*a*, 116*b*. Rotary transfer apparatus 110 may also rotate engagement elements 116*a*, 116*b*. The combined result of such movement is that engagement elements are brought again to a position and are operable to retrieve the next KD blank 200 from the blank holding apparatus 150. Then the cycle may start again.

Rotary transfer apparatus 110 may rotate the engagement elements 116*a*, 116*b* in such a manner that first pair of engagement elements 116*a* engaging a KD blank 200 may follow the same rotational path as second pair of engagement elements 116*b* engaging another KD blank 200, relative to sliding apparatus 120, but with the engagement elements 116*a*, moving and operating 180 degrees out of phase with engagement elements 116*b*.

Now specific components and the operation of carton feeder 100 are hereinafter described in more detail. In general, the components of carton feeder 100 may be made of suitable known materials. For example, some components may be made from suitable steels, aluminum and other metals. Again with particular reference to FIG. 1B, carton holding apparatus 150 may comprise a carton blank magazine 152 which may have a discharge opening 154 through which KD blanks 200 from the stack 210 may be withdrawn in series, one at a time, by engagement elements 116*a*, 116*b*. Carton storage magazines of this type are well known and, consequently, the mechanism which controls the dispensing of the blanks to ensure that they are discharged one at a time when engaged by engagement elements 116*a*, 116*b* will not be described in detail herein.

With particular reference back again to FIG. 1A, carton blank magazine 152 may also be equipped with an apparatus for auto-loading KD blanks 200. Such auto-loading apparatus may be blank in-feed conveyor 103, which may be loaded manually or automatically (such as with a robotic loader—not shown) at an input end with stacks 210 of flattened KD blanks 200. Stack in-feed conveyor 103, under control of PLC 109 may move stacks 210 of KD blanks 200 to the loaded position in magazine 152, such that stacks of KD blanks can be supplied as necessary to ensure that the blank magazine 152 remains loaded with blanks arranged in series for retrieval.

Magazine 152 may be configured such that KD blanks 200 are oriented in a manner which is favourable for retrieval in series by rotary transfer apparatus 110. For example, each stack 210 may be oriented such that when held in magazine 152 ready to be retrieved by rotary transfer apparatus 110, each KD blank 200 is positioned with an engagement surface that lies substantially parallel to the engagement surface of engagement elements 116*a*, 116*b* when the engagement elements are at the pick-up location as defined by the rotational movement of rotary apparatus 110.

Magazine 152 may be supported on sub-frame 160 in a cantilevered manner by transversely spaced, longitudinally oriented support beams 162/163 which may be connected to respective vertically oriented support columns 164/165. Longitudinal beams 162/163 and vertical support columns 164/165 may form components of sub-frame 160. Sub-frame 160 may also include transverse beam 161 which may fixedly inter-connect, stabilize and support longitudinal support beams 162 and 163. Magazine 152 may be positioned and operable to be size adjustable to accommodate KD blanks 200 of varying dimensions.

Figure 2:
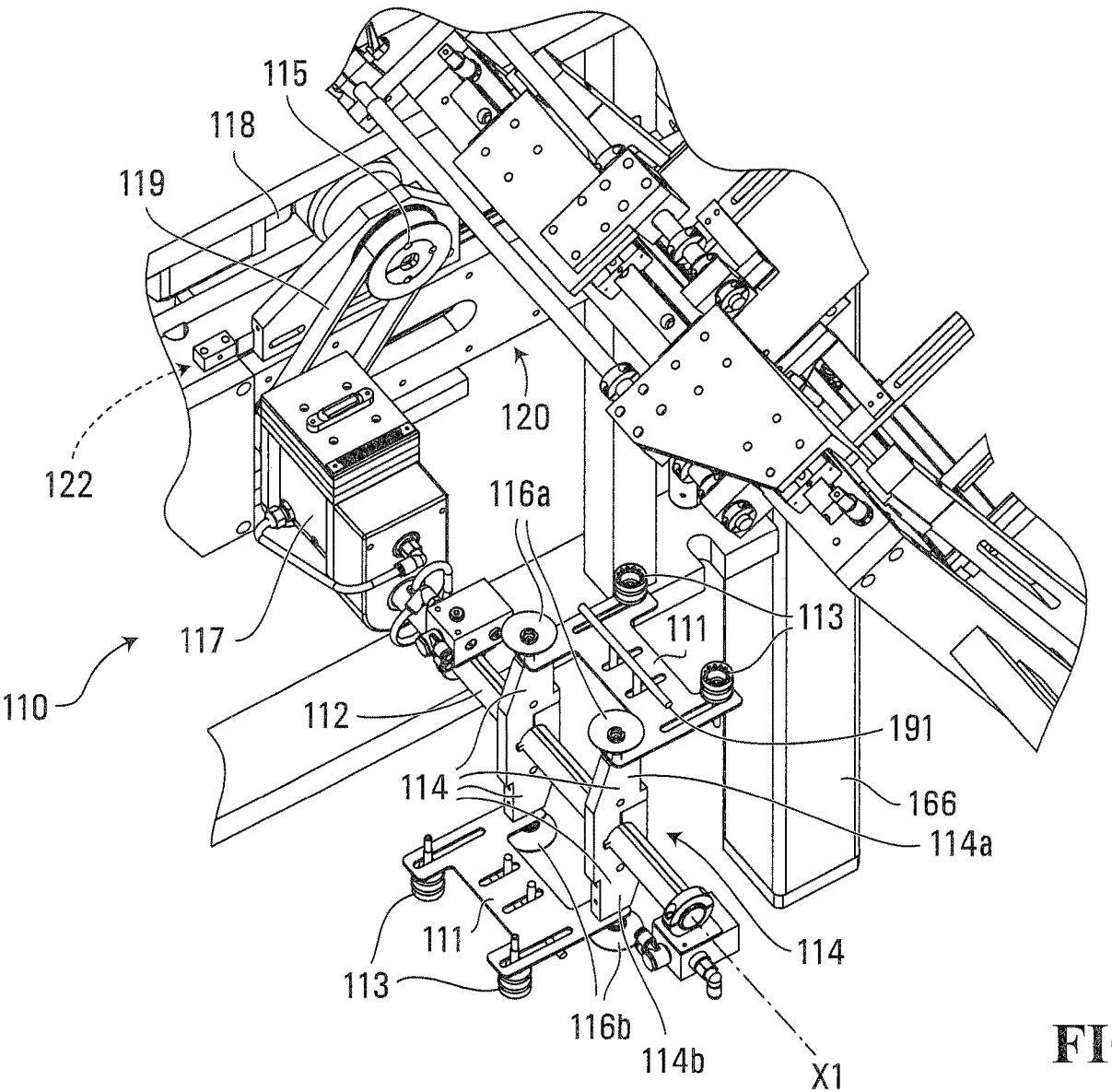
FIG. 2 is another perspective view of the carton feeder of FIG. 1B with some components omitted for simplicity to show a rotary transfer apparatus.

With particular reference to FIG. 2, rotary transfer apparatus 110 may be any suitable rotary apparatus that is operable to rotate engagement elements, such as opposed pairs of engagement elements 116*a*, 116*b*, in a desired rotational path. By way of example, rotary transfer apparatus 110 may be configured generally in the same manner as the rotary transfer mechanisms disclosed in U.S. Pat. No. 3,937,458 that issued to Marinus J. M. Langen on Feb. 10, 1976 and U.S. Pat. No. 4,537,587 to Marinus J. M. Langen on Aug. 27, 1985, the entire contents of both of which are hereby incorporated by reference herein.

Rotary transfer apparatus 110 may include a transversely oriented rotary shaft member 112 that may rotate about transversely oriented axis X1 (FIG. 2). Rotary transfer apparatus 110 may include a gearing mechanism 117 configured to provide a desired cyclical path of rotary shaft member 112 relative to the sliding assembly components of sliding apparatus 120 to which rotary transfer apparatus 110 is mounted, as well to provide for a desired rotational movement of rotary shaft member 112 about its own transversely oriented axis X1 (FIG. 2).

Figure 3:
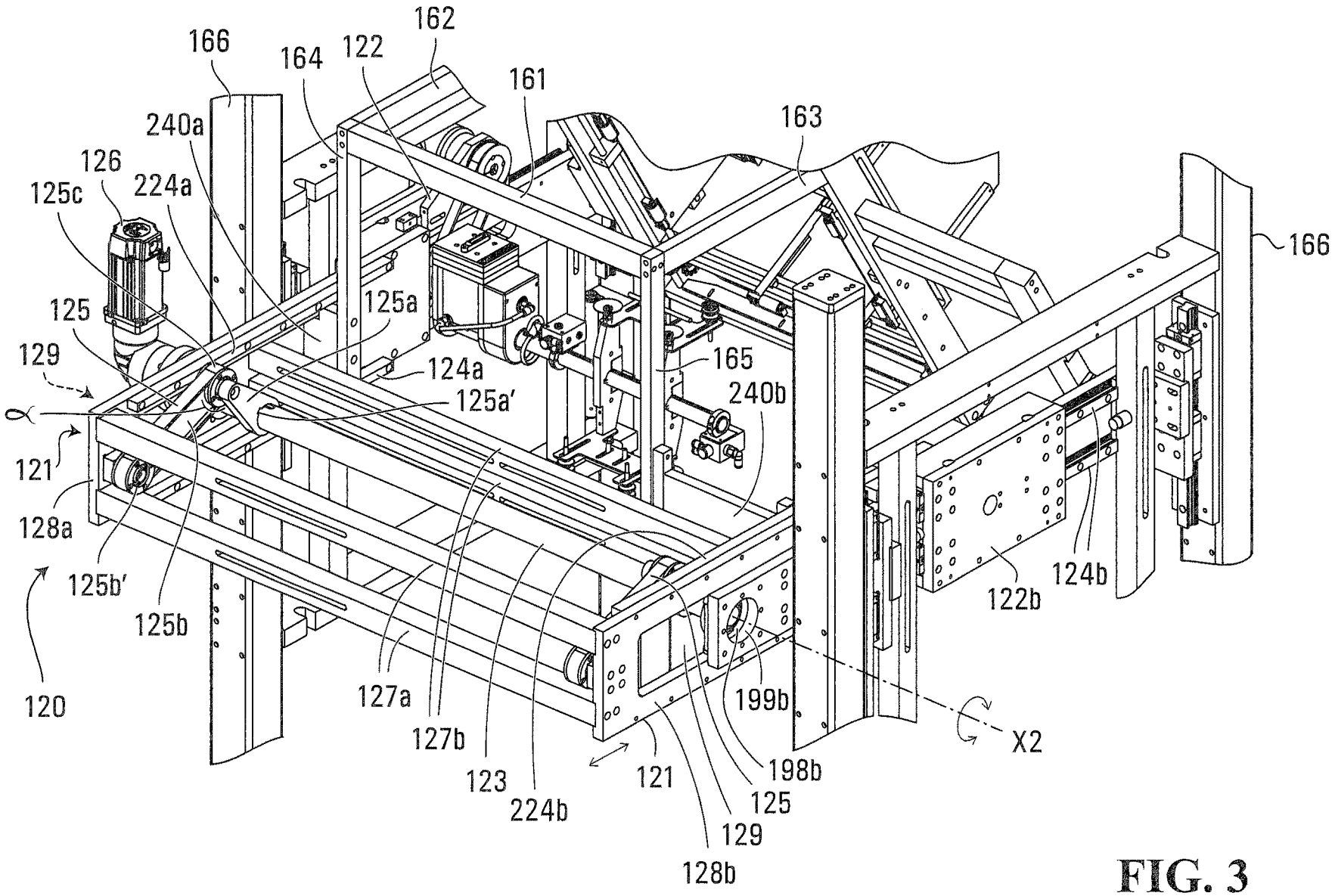
FIG. 3 is another perspective view of the carton feeder of FIG. 1B with some components omitted to show a slide apparatus.
Figure 6:
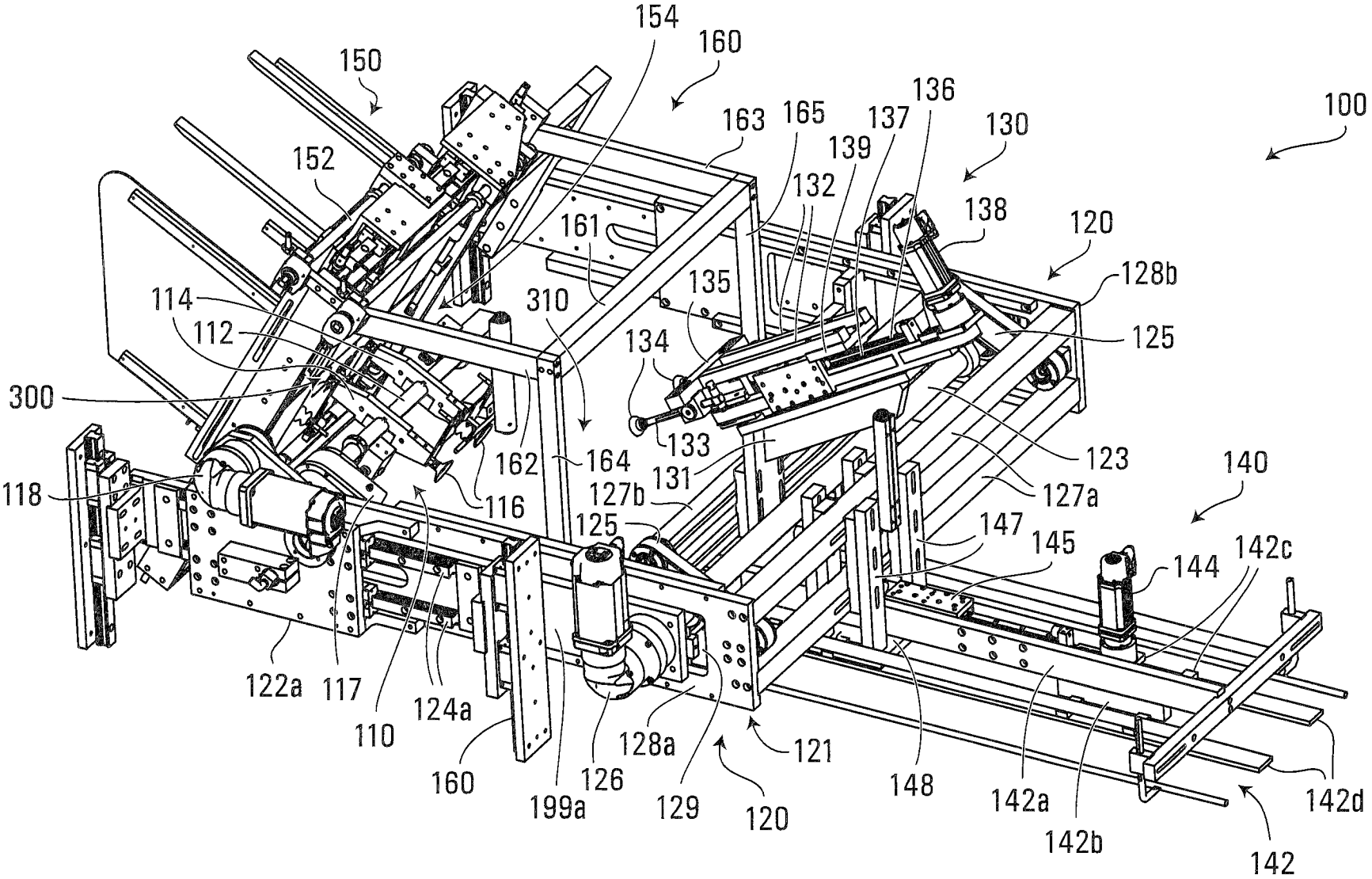
FIG. 6 is perspective view of the carton feeder of FIG. 1B showing the rotary transfer apparatus engaging a KD blank held in a magazine.

With particular reference to FIGS. 3 and 6, rotary transfer apparatus 110 may be mounted to a slide assembly 121 of slide apparatus 120 via a slidable support bracket/carriage 122*a* that may be mounted on vertically spaced rails 124*a*. Rails 124*a* may be mounted to support plate 199*a* (FIG. 6) that is attached to sub-frame 160. Thus rails 124*a* may be fixed relative to sub-frame 160 allowing bracket/carriage 122*a* to slide on rails 124*a* with sliding longitudinal movement. As can be seen in FIG. 3, a corresponding set of rails 124*b* may provide support for a corresponding bracket/carriage 122*b*. Rails 124*b* may be mounted to a support plate 199*b* (FIG. 3) that is attached to sub-frame 160. Thus rails 124*b* may be fixed relative to sub-frame 160 allowing bracket/carriage 122*b* to slide on rails 124*b* with sliding longitudinal movement. However, bracket/carriage 122*b* in the illustrative embodiment does not support a side of rotary transfer apparatus 110. Bracket/carriage 122*a* may be interconnected to bracket/carriage 122*b* such that they move together in reciprocating translational longitudinal movement.

As shown, rotary shaft member 112 along with gearing mechanism 117 may be rotatably mounted in a cantilevered manner from support bracket 122. In other embodiments, carriage 122*b* may support an opposite side of rotary transfer apparatus.

Bracket/carriage 122*a* may also be interconnected and secured to a longitudinally and vertically oriented plate member 128*a* forming part of slide assembly 121 of slide apparatus 120 (see FIG. 6). Thus plate member 128*a* and bracket carriage 122*a* may move and be supported together on rail 124*a*. Bracket/carriage 122*b* may also be interconnected and secured to another transversely spaced and longitudinal and vertically oriented plate member 128*b*, also forming part of slide assembly 121 of slide apparatus 120. Thus plate member 128*b* and bracket carriage 122*a* may move and be supported together on rail 124*b*. The driven movement of slide plates 128*a*, 128*b* as described further hereinafter, can drive the bracket/carriages 122*a*, 122*b* in reciprocating translational longitudinal movement, and thus also move the rotary transfer apparatus 110 mounted to bracket/carriage 122*a* in the same movement.

With particular reference to FIG. 2, a plurality of radial arms 114 may extend radially outwards from and be fixed to rotary shaft member 112. In this case, there is a transversely spaced pair of radial arms 114, each transversely spaced apart from each other. Each radial arm 114 has a first portion 114*a* extending radially outwards from rotary shaft member 112 in one direction and a second portion 114*b* extending radially outwards from rotary shaft member in an opposite direction to first portion 114*a*, such that first portion 114 and second 114*b* are oriented 180 degrees apart from each other. The result is that there are a pair of spaced first radial arm portions 114*a* extending in one direction and a pair of spaced second radial arm portions 114*a* extending at 180 degrees to the pair of first radial arm portions 114*a*. Each of the radial arm portions 114*a*, 114*b* may include a pick up element 116 proximate an end thereof. Each engagement element 116 may be a vacuum-actuated suction cup coupled to a vacuum generator. Apparatus for providing vacuum from a stationary vacuum generator to a plurality of continuously rotating suction cups are known in the art (e.g. U.S. Pat. No. 3,937,458). Separate vacuum generators 195*a*, 195*b* (FIG. 4) may be mounted on shaft member 112 and/or arms 114 near to the suctions cups/engagement elements 116*a*, 116*b*. Vacuum generators 195*a*, 195*b* may use compressed air supplied by pipes (not shown) at an inlet and convert the compressed air into a stream of attracted air (i.e. a vacuum) which is in air communication via tubes/passageways with the suction cups/engagement elements 116*a*, 116*b*. An example of a vacuum generator that would be suitable for use in carton feeder 100 is produced PIAB AB under model no. PCL.X4BN.S.EE.SV.

Valves (not shown) may be provided in the supply of pressurized air to the vacuum generators and the valves may be controlled by PLC 109 based on signals provided by an encoder associated with servo drive motor 118 (as described below) associated with rotary transfer apparatus 110. PLC 109 may thus control the turning on and off of suction of engagement members 116*a*, 116*b* during movement about the rotational and translational path (i.e. turn the suction on and off depending upon the position of each of pairs of engagement members 116*a*, 116*b*).

The first radial arm portions 114*a* are transversely spaced apart and operable such that first pair of engagement elements 116*a*, can engage, rotate and release KD blanks 200 they retrieve from blank holding apparatus 150. The second radial arm portions 114*b* move and operate out of phase by 180 degrees to the first radial arm portions 114*b*, and second radial arm portions 114*b* are also operable such that the second pair of engagement elements 116*b* can separately engage, rotate and release KD blanks 220 they retrieve from the blank holding apparatus 150.

Rotary transfer apparatus 110 may be configured such that first and second pairs of radial arm portions 114*a*, 114*b*, and in particular the respective engagement elements 116*a*, 116*b* secured thereto, move in a rotational path (and in particular a hypotrochoidal/hypocycloidal cylical path relative to the sliding components of sliding apparatus 120 like the suction cups of the rotary transfer mechanisms in U.S. Pat. Nos. 3,937,458 and 4,537,587).

Figure 4:
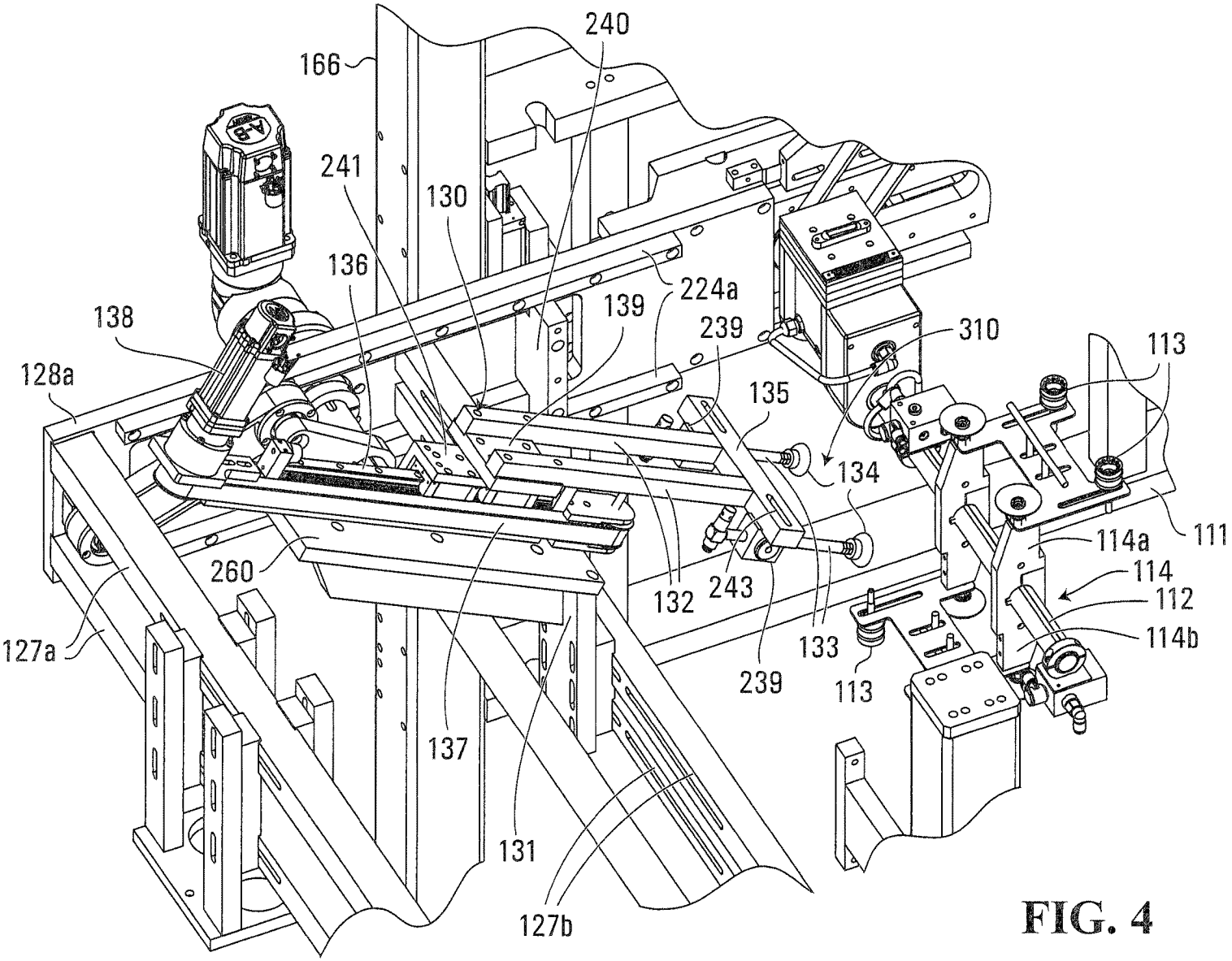
FIG. 4 is a perspective view of the carton feeder of FIG. 1B with some components omitted to show a carton opening apparatus.

With particular reference to FIGS. 2 and 4, each pair of first radial arm portions 114*a*, and each pair of second radial arm portions 114*b* may also have a support platform 111 mounted proximate and extending between the end of the respective pairs of radial arm portions 114*a*, 114*b*. Support elements 113. Support elements 113 which may be rubber pad members may be attached to and extend generally radially outward from support platforms 111. Support elements 113 and support bar 191 co-operate with engagement elements 116*a*, 116*b* during retrieval and movement of a KD blank 200 engaged by engagement elements 116*a*, 116*b*. The number, location and configuration of engagement elements 116*a*, 116*b*, support bar 191 and support elements 113 on each platform 111 may vary provided they facilitate the rotational movement of KD blank 200 by rotary transfer apparatus 110. Engagement elements 116 and support elements 113 may be positioned substantially at the four corners of platform 111 which may be orthogonally mounted between one of first radial arms portions 114*a* or second radial arm portions 114*b*. The positions of support bar 191 and support elements 113 may be adjusted to suit the particular dimensions of the particular KD blank 200 being processed.

Rotary shaft member 112 may, by way of example only, be typically in the range of between 24 and 36 inches in length.

Rotary shaft member 112 may be made of any suitable material (such as steel or stainless steel) which is suitably strong and rigid to support plurality of radial arms 114, platforms 111, support elements 113 and engagement elements 116 (as well as KD blank 200) and be able to withstand the forces imparted thereon during operation. Likewise, radial arms 114 and platforms 111 may be made from suitable materials such as aluminum or be plastic 3D printed.

With particular reference to FIG. 2, rotary transfer apparatus 110 may also include a drive belt 119, and a servo drive motor 118. Rotary shaft member 112 may be inter-connected to drive wheel 115 of servo drive motor 118 by way of drive belt 119 and gear mechanism 117. Servo drive motor 118 may in operation drive the drive belt to move the rotary shaft member 112 in a cyclical rotational path relative to bracket/carriage 122. Servo drive motor 118 may include an encoder and may be in communication with 109 such that the rotational movement of rotary transfer apparatus 110 including rotary shaft member 112, and the arms 114 and engagement members 116*a*, 116*b*, that are fixedly secured thereto, can be controlled by PLC 109. The type of specific mechanisms that would be operable to drive rotation of such components of a rotary transfer mechanism via a servo motor/belt/gear mechanism are known to those skilled in the art. Servo drive motor 118 may be any type of servo drive motor which is capable of driving the rotational movement of rotary shaft member 112. For example, servo drive motor 118 may be a model VPL-A1003F made by Allen Bradley. Servo drive motor 118 may, by way of example only, drive the rotation of rotary member 112 at a maximum rotational speed between 10 and 400 rpm. Servo drive motor 118, drive belt 119, gear mechanism 117, and rotary shaft member 112 may be mounted on support bracket/carriage 122 for sliding translational longitudinal movement together relative to sub-frame 160. Bracket/carriage 122 may be part of a slide assembly 121 of slide apparatus 120. The sliding movement of bracket/carriage 122, as part of slide assembly 121, may provide for the translational movement of rotary transfer apparatus 110 between proximate and distal positions relative to blank holding apparatus 150.

With particular reference to FIGS. 2, 3, 4, 5 and 6, as described above, slide assembly 121 may include transversely spaced, vertically and longitudinally oriented, sliding plates 128*a*, 128*b*. Sliding plates 128*a*, 128*b* may each be attached to brackets/carriages 122*a*, 122*b*, such that together they are configured to be supported on and move with sliding motion longitudinally relative to, respective transversely spaced, longitudinally oriented rails 124*a*, 124*b* (See FIG. 3).

Figure 5:
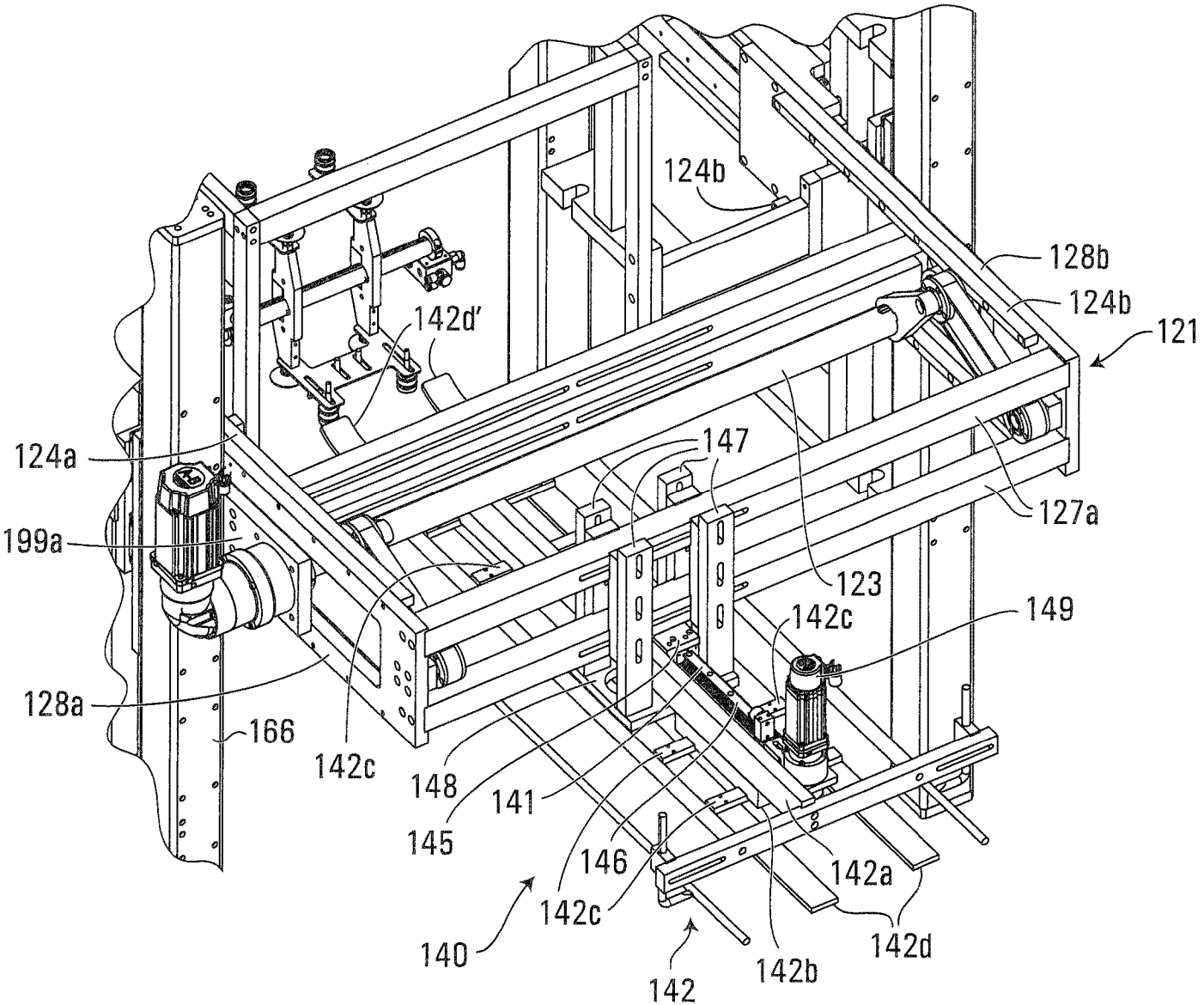
FIG. 5 is perspective view of the carton feeder of FIG. 1B with parts omitted to show a hold-down apparatus.

Guide rails 224*a* may be mounted to sliding plate 128*a* (FIG. 6) and guide rails 224*b* may be mounted to sliding plate 128*b* (FIG. 5). Vertical support plates 240*a*, 240*b* may also be secured to sub-frame 160 (See FIGS. 3 and 4) to provide transverse guides for movement of sliding plates 128*a*, 128*b*.

As indicated above, support bracket/carriage 122*a* may be fixedly secured to slide plate 128*a*. Rotary transfer apparatus 110 may thus be interconnected to slide plate 128*a* via bracket 122/carriage, and slide plates 128*a*, 128*b* may be configured to translate together along respective rails 124*a*, 124*b*. Thus, slide plates 128*a*, 128*b* may be configured to have reciprocating translational movement in the longitudinal direction relative to sub-frame 160, and thus provide for the reciprocating translational movement of rotary transfer apparatus 110 in a longitudinal direction relative to blank holding apparatus 150.

Slide plates 128*a*, 128*b* may be fixedly spaced relative to each other by interconnecting transverse beams 127*a* and 127*b* (FIG. 5). An opening 129 may be provided between slide plates 128*a*, 128*b*/rails 224*a*, 224*b* and beams 127*a*, 127*b*. Transverse beams 127*a* and 127*b* may be fixed at generally right angles to longitudinal sliding plates 128*a*, 128*b* such that parts of slide assembly 121 form edges of a generally rectangular prism.

Also as shown in FIG. 3, slide apparatus 120 may also comprise a servo drive motor 126, a drive shaft 123 and linkage mechanism 125. Servo drive motor 126 may mounted to fixed plate 199*a* (FIG. 5) and be configured to drive the rotation of drive shaft 123 about a transverse axis X2 (FIG. 3) through drive shaft 123, and both these components may be fixed relative to sub-frame 160 such that they do not translate in longitudinal movement with slide assembly 121. An opposite end of drive shaft 123 may mounted in an opening 198*b* containing a rotatable bearing in fixed plate 199*b* (FIG. 3).

Servo drive motor 126 may be any type of servo drive motor which is capable of driving the rotational movement of rotary drive shaft 123 about axis X2 in both clockwise and anti-clockwise directions. For example, servo drive motor 126 may be a model VPL-A1153C made by Allen Bradley.

Servo drive motor 126 may include an encoder and may be in communication with PLC 109 such that the rotational movement of rotary drive shaft 123, and the linkage mechanism 125 connected thereto, can be controlled by PLC 109.

Linkage mechanism 125 may be configured to convert the rotation of rotary drive shaft 123 into the translational longitudinal movement of slide assembly 121. For example, linkage member 125 may have a first portion 125*a* with a distal end 125*a*' which is keyed to drive shaft 123, a second portion 125*b* with a distal end 125*b*' which is rotatably fixed to slide assembly 121, and a hinge portion 125*c* which connects adjacent ends of first and second portions 125*a*, 125*b* and defines an angle α between first portion 125*a* and second portion 125*b*. In this configuration, distal end 125*a*' of linkage member 125 is fixed from longitudinal translational movement due to its connection with drive shaft 123. In contrast, distal end 125*b*' of linkage member 125 is translatable due to its connection with slide assembly 121.

Referring to FIG. 3, the transfer of rotational motion of rotary drive shaft 123 to reciprocating translational longitudinal motion of slide assembly 121 may be provided as follows: (i) rotation of drive shaft 123 in a first counter clockwise direction may rotate first portion 125*a* towards transverse beams 127*a* of slide assembly 121, (ii) this rotation may "push" distal end 125*b*' of second portion 125*b* away from drive shaft 123 (increasing angle α at hinge portion 125*c*), and (iii) the vertically and transversely fixed, pivotal connection between distal end 125*b*' of second portion 125*b* and slide assembly 121 may cause slide assembly 121 to translate in a longitudinal direction along rails 124*a*, 124*b*. Thus, rotation of drive shaft 123 in the first counter-clockwise direction may cause slide assembly 121, and rotary transfer apparatus 110 mounted thereon, to translate away from blank holding apparatus 150.

Rotation of drive shaft 123 in a second clockwise direction (opposite to the first direction), may return first portion 125*a* of linkage member 125 to its earlier position, which may "pull" slide assembly 121 back to its earlier position as angle α is decreased. As rotary transfer apparatus 110 may be mounted on slide assembly 121 (via bracket 122), the rotation of drive shaft 123 in the second direction may return rotary transfer apparatus 110 to its earlier position proximal to blank holding apparatus 150 (i.e. pick-up/retrieval location 300).

The slide apparatus 120, including slide assembly 121 and linkage mechanism 125, and drive shaft 123 may be configured such that servo drive motor 126 may, by way of example only, drive the rotation of drive shaft 123 through only a portion of a full rotation, such as for example an angle of rotation of 120 degrees. In an example embodiment, this may equate to a longitudinal translation of slide assembly 121 by a distance of between about 5 and 10 inches. In particular, the components may be configured such that servo drive motor 126 may drive the longitudinal translation of slide assembly 121 a distance of about 7 inches. The distance travelled by slide assembly 121 may be adjusted to account for various processes including the size and shape of KD blank 200 and the sizes of the various components of carton feeder 100.

Drive shaft 123 may be in some embodiments be between 24 and 36 in length and between 1¼ and 1½ inches in diameter. Drive shaft 123 and linkage mechanism 125 may be made of one of more materials which are suitably strong and rigid to withstand the torsional force required to translate slide assembly 121 such as steel.

As noted above, drive shaft 123 may be rotatably mounted such that it does not translate with slide assembly 121. Openings 129 in longitudinal plates 128*a*, 128*b* allow for the translational motion of slide assembly 121 without interfering with the fixed longitudinal position of drive shaft 123 relative to sub-frame 160.

Slide apparatus 120 may comprise any number of linkage mechanisms 125. Preferably, slide apparatus 120 comprises two linkage mechanisms 125 spaced transversely apart from each other such as having with one proximate each end of drive shaft 123. Each linkage mechanism 125 may take a number of different configurations to transfer the rotational movement of drive shaft 123 into the longitudinal translation of slide assembly 121.

In other embodiments, other drive mechanisms are contemplated for driving the translational movement of slide assembly 121 and/or rotary transfer apparatus.

As best seen in FIGS. 4 and 6, carton feeder 100 may also comprise carton opening apparatus 130. Carton opening apparatus 130 is an example of what is sometimes referred to as a type of "pre-break" mechanism. An example of such as carton opening mechanism is disclosed in U.S. Pat. No. 4,537,587 as referred to above.

In carton feeder 100, carton opening apparatus 130 may comprise a pair of transversely spaced blank releasable panel attachment elements 134 (which may be suction cups as described above). Attachment elements 134 may be supported on fixtures 133. Fixtures 133 may be hollow rigid tube members that may be in air flow communication with the outlet of vacuum generators 239. Vacuum generators 239 may themselves be supported on a common transversely oriented support bar 135. Transverse support bar 135 may be supported by a pair of transversely spaced, longitudinal bars 132. Bars 132 may be mounted to a support plate 139. Support plate 139 may be mounted on a rail carriage 241 that may be movable along a rail 136.

Rail 136 may be fixedly interconnected to sub-frame 160. This may accomplished by centrally mounting rail 136 on a support plate 260. Support plate 260 maybe supported proximate one end thereof to a support bracket/post 131 that may be oriented vertically.

Vacuum generators 239 may be mounted on transverse bar 135 by having rods (not shown) engaging with slots 243 such that vacuum generators 239 and their fixtures 133 and attachment elements 134 may be selectively positioned along transverse bar 135. This may provide a mechanism to facilitate the adjustment of the spacing of multiple attachment elements 134 to allow for engagement with various sizes/shapes of KD blanks 200.

Preferably, releasable attachment elements 134 may be vacuum-actuated suction cups coupled to a vacuum generator. Similar to the vacuum generators referenced above, separate vacuum generators 239 may be mounted to transverse bar 135 any fixtures 133 may be mounted to an outlet of the vacuum generators 239. A vacuum generator suitable for this use is produced by PIAB AB sold under model no. PCL.X4BN.S.EE.SV.

Valves may be controlled by PLC 109 based on signals provided by an encoder associated with servo drive motor 118 (as described below) associated with rotational movement of rotary transfer apparatus 110 and signals provided from the encoder associated with servo drive motor 121 that are indicative of the translational movement and position of slide assembly 121 and rotary transfer apparatus 110. PLC 109 may thus control the actuation of suction of attachment elements 134 (i.e. turn the suction on and off depending upon the position of each of the pairs of attachment elements 134 and the position of the rotary transfer apparatus 110 and the engagement elements 113*a*, 113*b*.

Continuing with FIG. 4, angled bracket 131 may be mounted on transverse bars 127*b*. Transverse bars 127 may be affixed at each end to upper and lower rails 124*a* and 124*b*. Rails 124*a* may be secured to vertical support plate 240*a* which may be interconnected to sub-frame 160. As such, angled bracket may be fixed relative to support frame, and thus carton opening apparatus 130 will not translate with the longitudinal movement slide assembly 121 of rotary apparatus 110.

Support plate 139 may be mounted on a rail carriage 241 that may be movable along a rail 136. Still with reference to FIG. 4, carton opening apparatus 130 may also comprise a servo drive motor 138, a drive belt 137 which may be interconnected to rail carriage 241. Servo motor 138 may be in communication with and be controlled by PLC 109. Servo drive motor 138 may drive the drive belt 137 which may longitudinally translate rail carriage 241, and the components referenced above that are attached thereto, with reciprocating longitudinal movement. As such, servo drive motor 138 may be configured to drive the longitudinal translation of attachment elements 134 relative to sub-frame 160 and may be able to move attachment elements relative to engagement elements 116*a*, 116*b* of rotary transfer apparatus 110. This allows for the controlled movement of attachment elements 134 into/out of carton opening location 310 for interaction with KD blank 200.

Servo drive motor 138 may be any type of servo drive motor which is capable of driving belt 137. For example, servo drive motor 138 may be a model VPL-A0633F made by Allen Bradley. Servo drive motor 126 may include an encoder and may be in communication with PLC 109 such that longitudinal position of attachment elements 134 relative to sub-frame 160, and relative to engagement elements 116*a*, 116*b* can be controlled by PLC 109.

Servo motor 138 may drive the translation of attachment elements 134 a distance of 7 inches. The distance travelled may be adjusted to account for various process including the size and shape of KD blank 200/carton 220

Rail 136 may be made of any material which is strong enough to support the translation of carriage 139 and the components which translate therewith. Rails 136, and any other linear rails used in the system may be for example Bosch Rexroth standard rails with sliding blocks size 15 or 20.

As best seen in FIG. 5, carton erector 100 may further comprise hold-down apparatus 140. Hold-down apparatus 140 is an example of a release assistance and stabilization mechanism. Hold-down apparatus 140 may comprise hold-down members 142*d*, a rail 141, a drive belt 146, a servo drive motor 144, and a carriage 145. Hold down members 142*b* may be operable for limited reciprocating longitudinal movement and may engage a top surface area of a carton erected from a KD blank 200 once it has been deposited in a carton conveyor 105.

Hold-down apparatus 140 may be mounted to the rear of slide assembly 121 such that it moves in translational longitudinal movement with sliding assembly 121 and rotary transfer apparatus 110.

Hold down apparatus 140 may also include vertical columns 147 which may be fixedly attached to transverse beams 127*a* of slide frame 121. A plate 148 may be mounted to columns 147 such that plate 148 hangs from slide frame 121 in a substantially horizontal configuration. Rail 141 may be fixedly mounted to plate 148, and belt 146/servo drive motor 144 may also at least in part be supported by plate 148. The servo drive motor 144 and belt 146 may be configured to drive and translate carriage 145 in reciprocating longitudinal movement along rail 141.

Staying with FIG. 5, hold-down apparatus 140 may further comprise a hold-down assembly 142 which may comprise a longitudinal beam 142*a*, a spacer 142*b*, a transverse bracket 142*c* and hold-down members 142*d* having a proximal end 142*d*'. Longitudinal beam 142*a* may be fixedly attached to carriage 145 such that it translates therewith along rail 141. Hold-down members 142*d* may be fixedly attached to longitudinal beam 142*a* by way of spacers 142*b* and transverse brackets 142*c*. As such, hold-down members 142*d* may translate, along with the other components of hold-down assembly 142, with carriage 145. Taken together, the components of hold-down apparatus 140 provide a mechanism which is fixedly mounted to slide frame 121 such that it moves therewith through the actions of slide apparatus 120, and which additionally provides for the longitudinal reciprocating translation of proximal ends 142*d*' of hold-down members 142*d* relative to rail 141 under the control of PLC 109 into/out of release location 320 to facilitate the release of carton 220 from engagement elements 116*a*, 116*b* of rotatable transfer apparatus 110 (see FIG. 14(J-K and K-A).

Columns 147 and plate 148 may, independently, be of any shape, size or materials, provided that they cooperate to provide a platform for carriage 145 to translate along rail 141 as driven by belt 146 and servo motor 144.

Servo drive motor 144 may be any type of servo drive motor which is capable of driving belt 146, carriage 145, and the other components connected thereto. For example, servo drive motor 144 may be a model VPL-A0633F made by Allen Bradley. Servo drive motor 144 may include an encoder and may be in communication with PLC 109 such that longitudinal position of hold down members 142*d* relative to rail 141, and relative to the slot on conveyor 105 at the release location holding an erected deposited carton, can be controlled by PLC 109.

Servo motor 144 may by way of example only drive the translation of hold down members 142*d* a distance of in the range of 4 to 12 inches. The distance travelled may be adjusted to account for various factors including the size and shape of KD blank 200/carton 220.

Each component of hold-down apparatus 142 may be of any size, shape and material provided that they cooperate to facilitate the release of carton 220 at release location 320. For example, hold-down member 142*d* may be ski-, rod-, or bar-shaped, and proximal ends 142*d*' of hold-down member 142 may be curved upwards to better facilitate the release of carton 320 from rotary transfer apparatus 110.

In operation, carton feeder 100 including rotary transfer apparatus 110 and each set of its engagement elements 116*a*, 116*b*, may pass through the sequence of configurations generally set out in FIGS. 6-13. FIG. 14 provides a series of schematic sequential diagrams of the movement of components associated with a set of engagement elements 116*a*, 116*b* of carton feeder 100 in diagrams listed as (A)-(K). It shows in isolation only the movements of the components associated with the cycle of movement of only one of the sets of engagement elements 116*a* through the pick-up, blank opening and carton drop off sequence of movement. It will be appreciated that the movements of carton feeder 100 associated with one set of engagement elements 116*a* will be the same as the movements of carton feeder 100 associated with the other set of engagement elements 116*b*, but they will be moving 180 degrees out of phase with each other. However, the engagement elements 116*a* will follow the same overall path as the engagement elements 116*b*. During operation, the path for each engagement elements 116*a*, 116*b* will be a combination of the rotational path imparted by the rotary transfer apparatus 110 and the reciprocating longitudinal translational movement imparted by the slide apparatus 120, evident from the following description with reference to FIGS. 6 to 14.

Referring to FIGS. 6 and 14(A), rotary transfer apparatus 110 and engagement elements 116*a* may be positioned in an engagement position to engage with and retrieve KD blank 200 from stack 210 while held in blank holding apparatus 150. Slide apparatus 120 may be in its retracted position towards blank holding apparatus 150 and sliding assembly 121 may be stationary relative to sub-frame 160. The pair of engagement elements 116*a* may be positioned to engage KD blank 200 in retrieval/engagement location 300. Rotation of engagement elements 116*a* by rotary transfer apparatus 110 may have ceased, if only for a very short time when engagement elements 116*a* engage with the KD blank 200. PLC 109 may operate carton feeder 100 to provide a vacuum force at engagement elements 116*a* to enable them to engage with a facing surface of KD blank 200 and retrieve a KD blank from blank holding apparatus 150.

Figure 7:
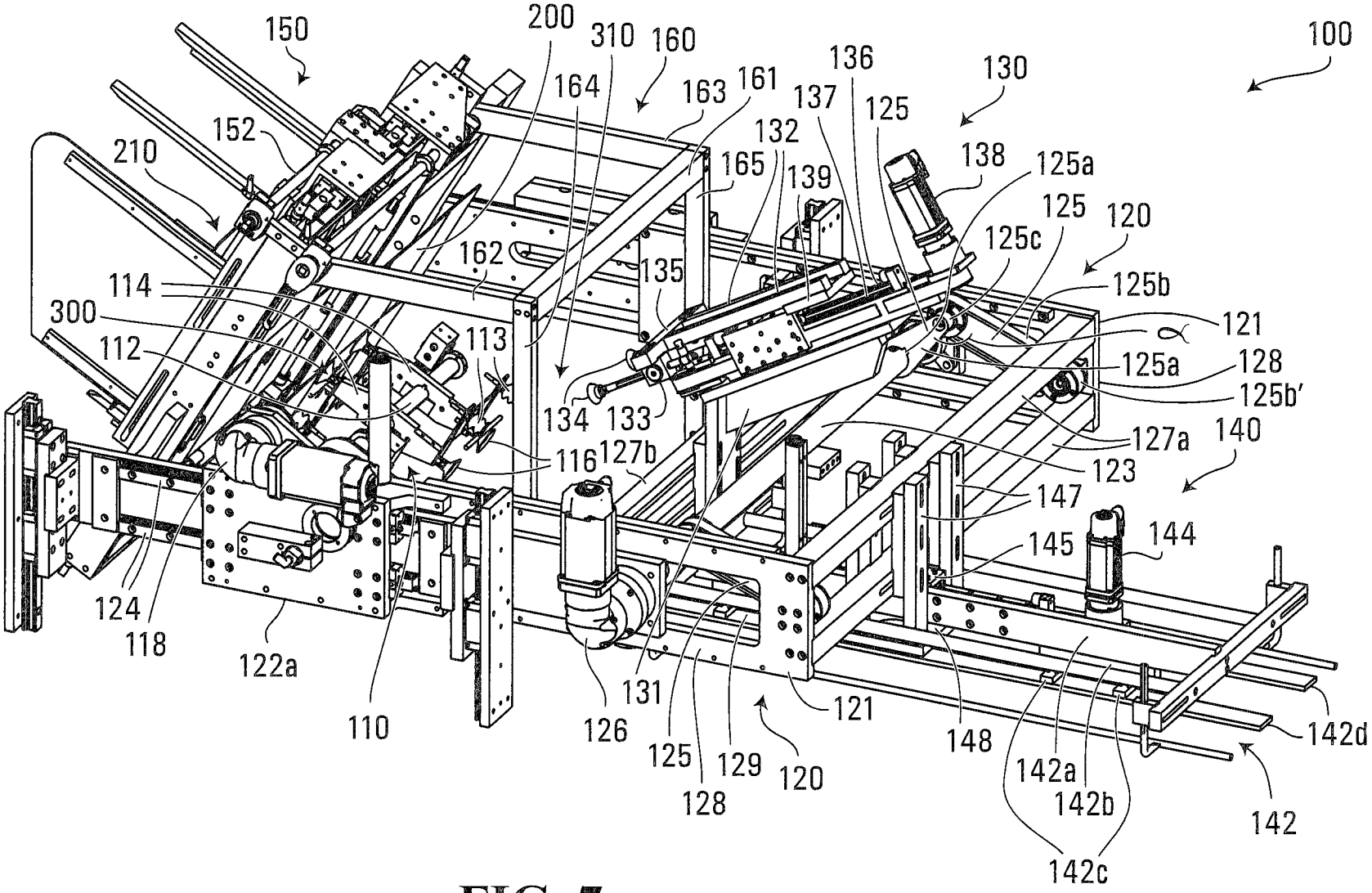
FIG. 7 is perspective view of the carton feeder of FIG. 1B showing the slide apparatus in an extended position such that the KD blank is translated away from the magazine.

Referring to FIGS. 7 and 14(B), after KD blank 200 has been engaged by engagement element 116, there may still be no rotation of engagement elements 116*a* commenced by rotary transfer apparatus 110. Slide apparatus 120 may however be engaged by PLC 109 to move the slide assembly 121 including hold down apparatus 140, into its extended position further away from blank storage apparatus 150 (via rotation of drive shaft 123 by servo drive 128 and translation of slide assembly 121). The translational movement of slide assembly 121 with rotary transfer apparatus 110 interconnected thereto may provide a clearance space between retrieved KD blank 200 and stack 210 as retrieved KD blank 200 is translated away from retrieval location 300. This clearance space allows the engagement elements 116*a* to rotate the KD blanks 200 without the KD blank interfering with or contacting the blank holding apparatus 150 or the plurality of KD blanks still held therein.

In some embodiments, the clockwise rotation of engagement elements 116*a* may be commenced by rotary transfer apparatus 110 after time slide assembly 121 starts to move the rotary transfer apparatus 110 in translational movement away from blank holding apparatus 150. In some embodiments, the clockwise rotation of engagement elements 116*a* may be commenced by rotary transfer apparatus 110 at the same time slide assembly 121 starts to move the rotary transfer apparatus 110 in translational movement away from blank holding apparatus 150. In other embodiments, the clockwise rotation of engagement elements 116*a* may be commenced by rotary transfer apparatus 110 while slide assembly 121 is still moving the rotary transfer apparatus in translational movement away from blank holding apparatus 150.

Figure 8:
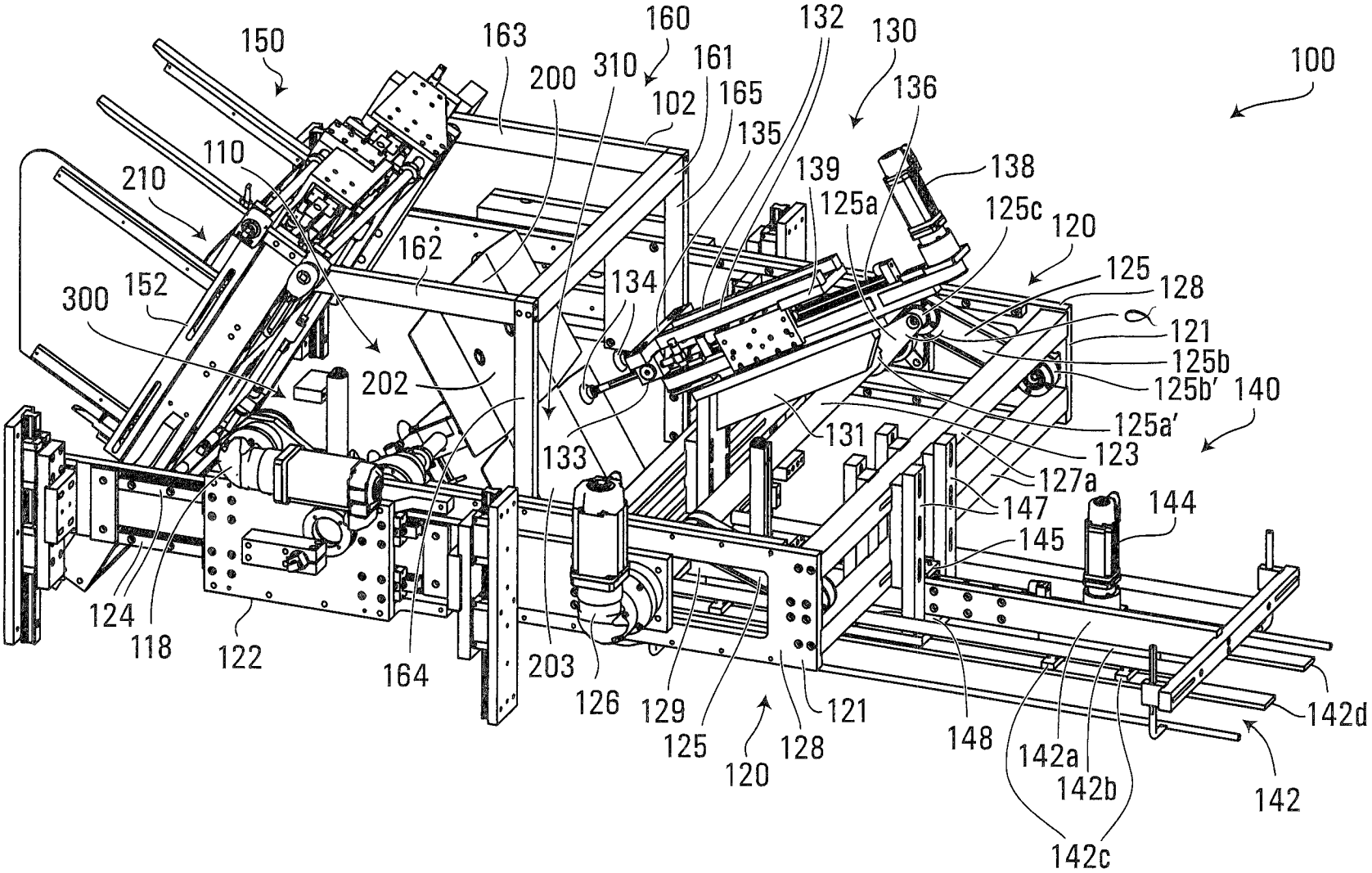
FIG. 8 is perspective view of the carton feeder of FIG. 1B showing the rotary transfer apparatus having rotated the KD blank into a carton opening location.

Referring to FIGS. 8 and 14C in this embodiment illustrated, the clockwise rotation of engagement elements 116*a* is commenced by rotary transfer apparatus 110 after slide assembly 121 has finished moving the rotary transfer apparatus and the engagement elements 116*a* in translational movement away from blank holding apparatus 150. While slide apparatus 120 remains in its extended translational position, rotation of rotary transfer apparatus 110 may move retrieved KD blank 200 into carton opening location 310. During rotation by rotary transfer apparatus 110 of engagement elements 116*a* and the KD blank 200 held by the same, between retrieval location 300 and carton opening location 310, contact between retrieved KD blank 200 and stack 210 may be reduced, minimized or eliminated, because of the clearance space established by the longitudinal translational movement of slide assembly 121 on which rotary transfer apparatus 110 is mounted (via bracket 122). Taken together, diagrams (C)-(F) of FIG. 14 present a schematic representation of this transition.

Figure 9:
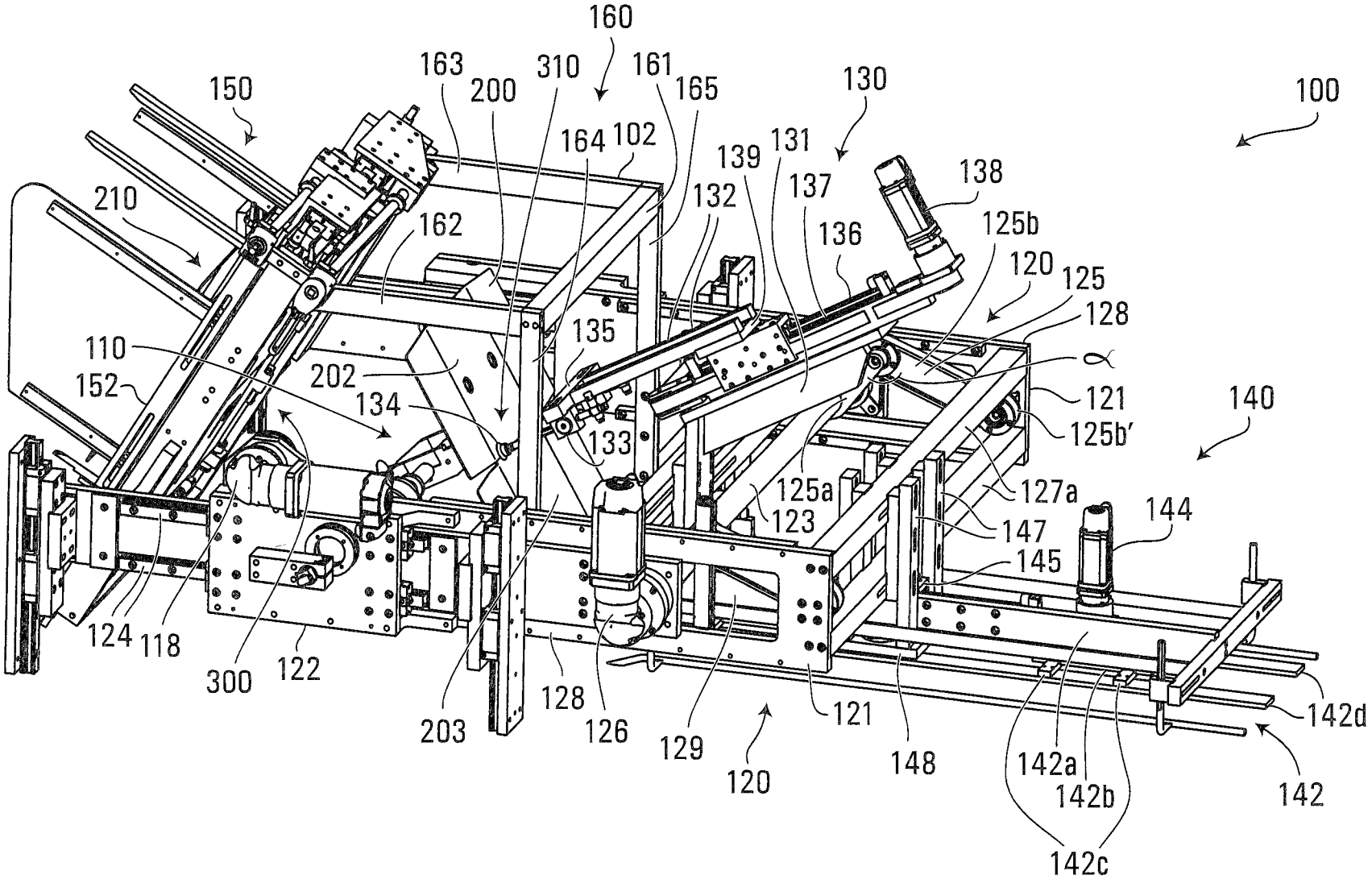
FIG. 9 is perspective view of the carton feeder of FIG. 1B showing the carton opening apparatus having moved into an extended position to engage the KD blank.

Referring to FIGS. 9 and 14(G), rotary transfer apparatus 110 may be configured to cease the rotation of engagement element 116*a* for a very short time, while attachment elements 134 may be translated into carton opening location 310 so as to engage with a facing surface of the retrieved KD blank 200 held by engagement elements 116*a*. The translation of attachment elements 134 into operation location 310 results from the movement of carton opening apparatus 130 from its retracted position to its extended position (i.e. by carriage 139 being driven by servo drive motor 138 under control of PLC 109 to cause translation along rail 136 towards carton opening location 310).

Figure 10:
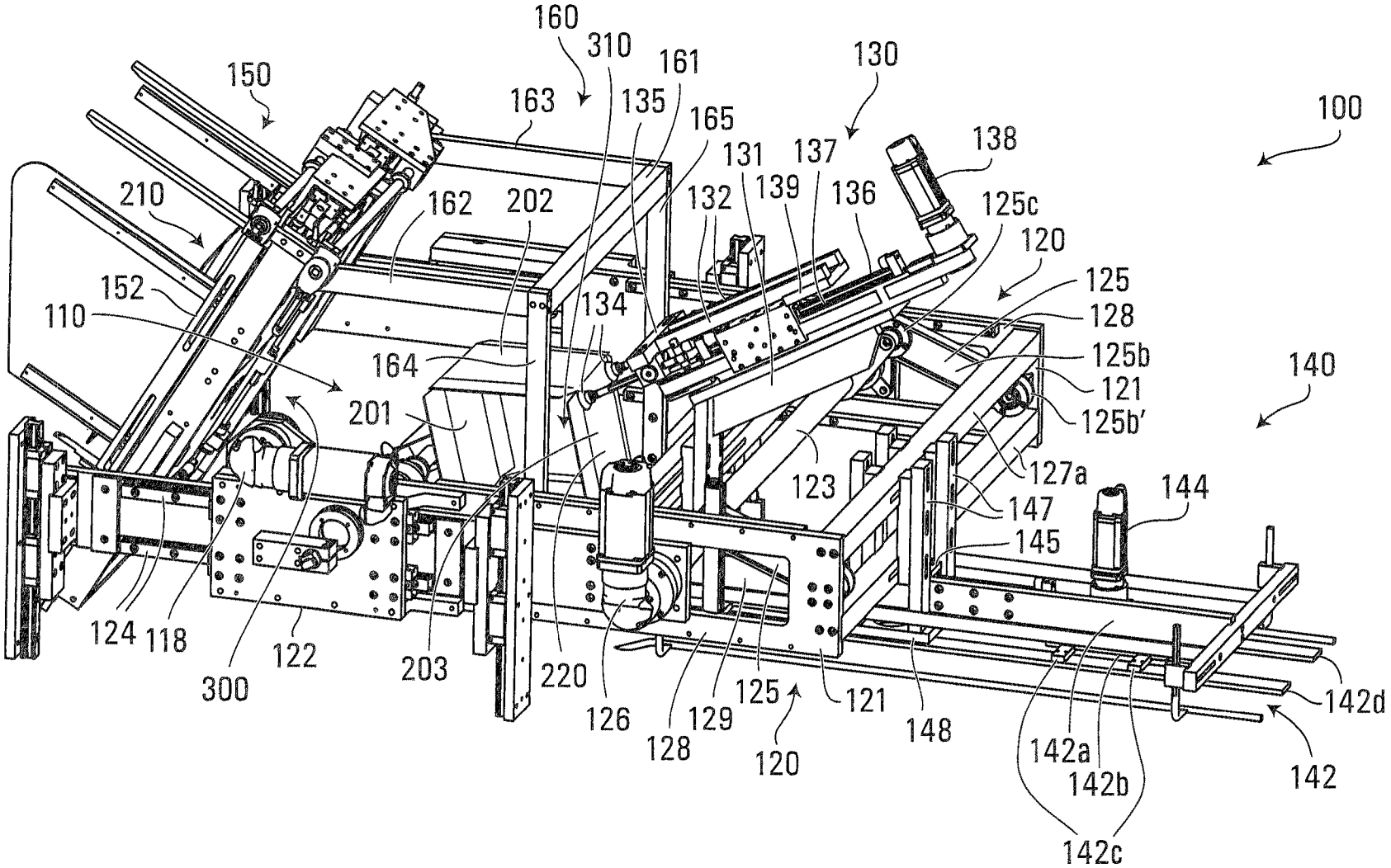
FIG. 10 is perspective view of the carton feeder of FIG. 1B showing the carton opening apparatus having returned to the retracted position and showing the rotary transfer apparatus having rotated now erect carton from the carton opening location.

Referring next to FIGS. 10 and 14(H), still with rotary apparatus 110 not having rotated engagement elements 116*a*, carton opening apparatus 130 may return to its retracted position and attachment element 134 may disengage (i.e. by carriage 139 being driven by servo drive motor 138 under control of PLC 109 to cause translation along rail 136 away from carton opening location 310). Prior to the release of the surface of KD blank 200 by attachment elements 134, the vacuum on attachment elements 134 may be maintained for a short time during retraction of attachment elements 134, to create a pulling force which is generally opposite to the force of engagement elements 116*a*, and may be considered perpendicular the engaged surface of KD blank 200, thereby at least partially erecting the KD blank 200 into carton 220.

Figure 11:
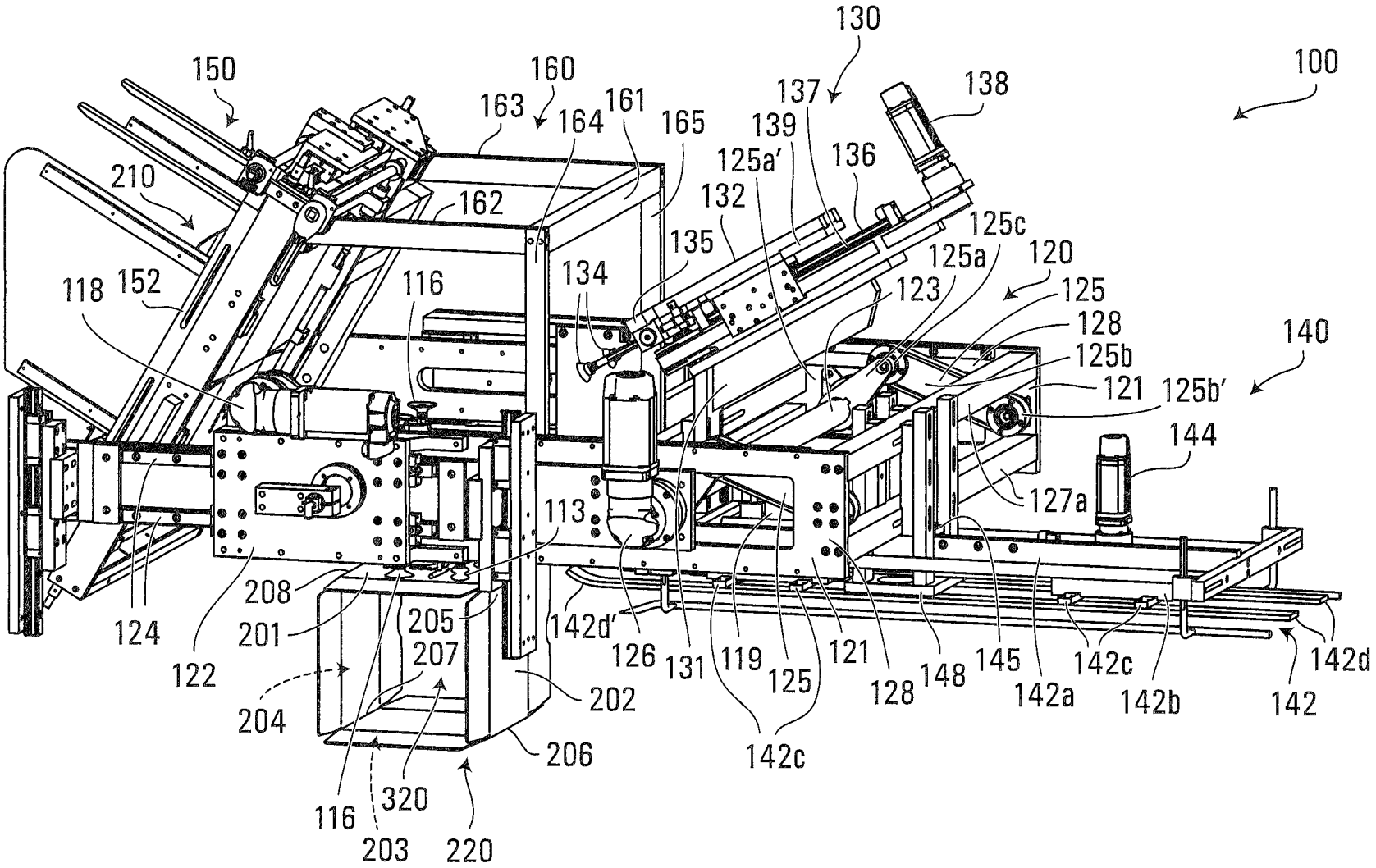
FIG. 11 is a perspective view of the carton feeder of FIG. 1B showing the rotary transfer apparatus having rotated the carton into a release location.

Referring next to FIG. 11 and diagrams (I)-(K) of FIG. 14, continued rotation of engagement elements 116*a* by rotary transfer apparatus 110 under control of PLC 109 may thereafter bring carton 220 into release location 320.

Figure 12:
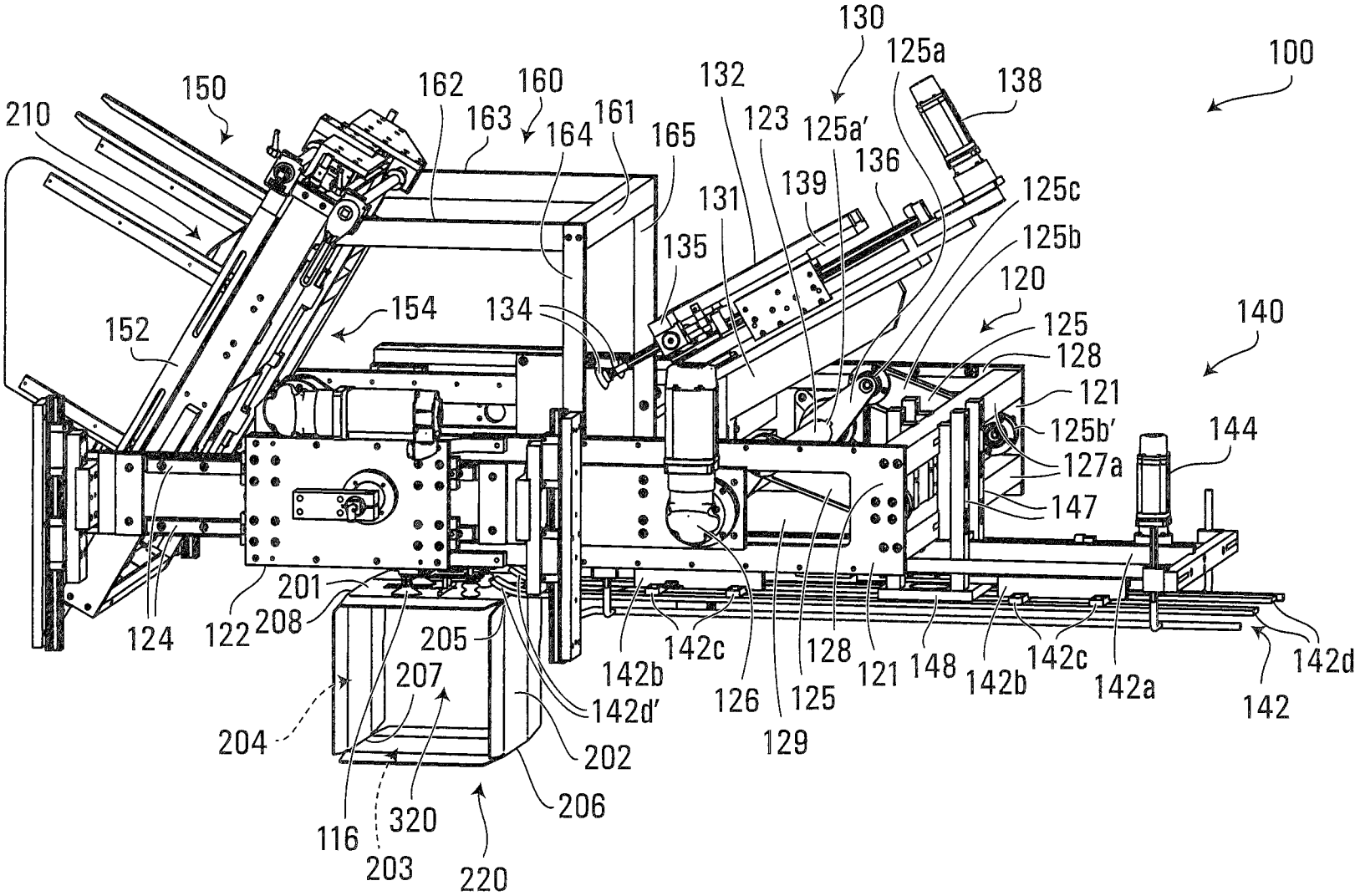
FIG. 12 is a perspective view of the carton feeder of FIG. 1B showing a hold-down apparatus having moved into an extended position to facilitate release of the carton from the rotary transfer apparatus in the release location.

Referring to FIG. 12 and diagram (K) of FIG. 14, hold-down apparatus 140 may move from its retracted position to an extended position to facilitate the release of carton 220 at release location 320. This may result from PLC 109 controlling servo drive motor 144 in such a manner to drive belt 146 and the corresponding carriage 145 on rail 141. Proximal ends 142*d*' of hold-down members 142*d* may be driven to a position above an upper surface of the carton 220 that has been received in carton conveyor 105 (not shown in these Figures) which may serve to stabilize carton 220 as it is released by the engagement elements 116*a* rotary transfer apparatus 110 as PLC 109 terminates the suction force on engagement element 116*a*.

Figure 13:
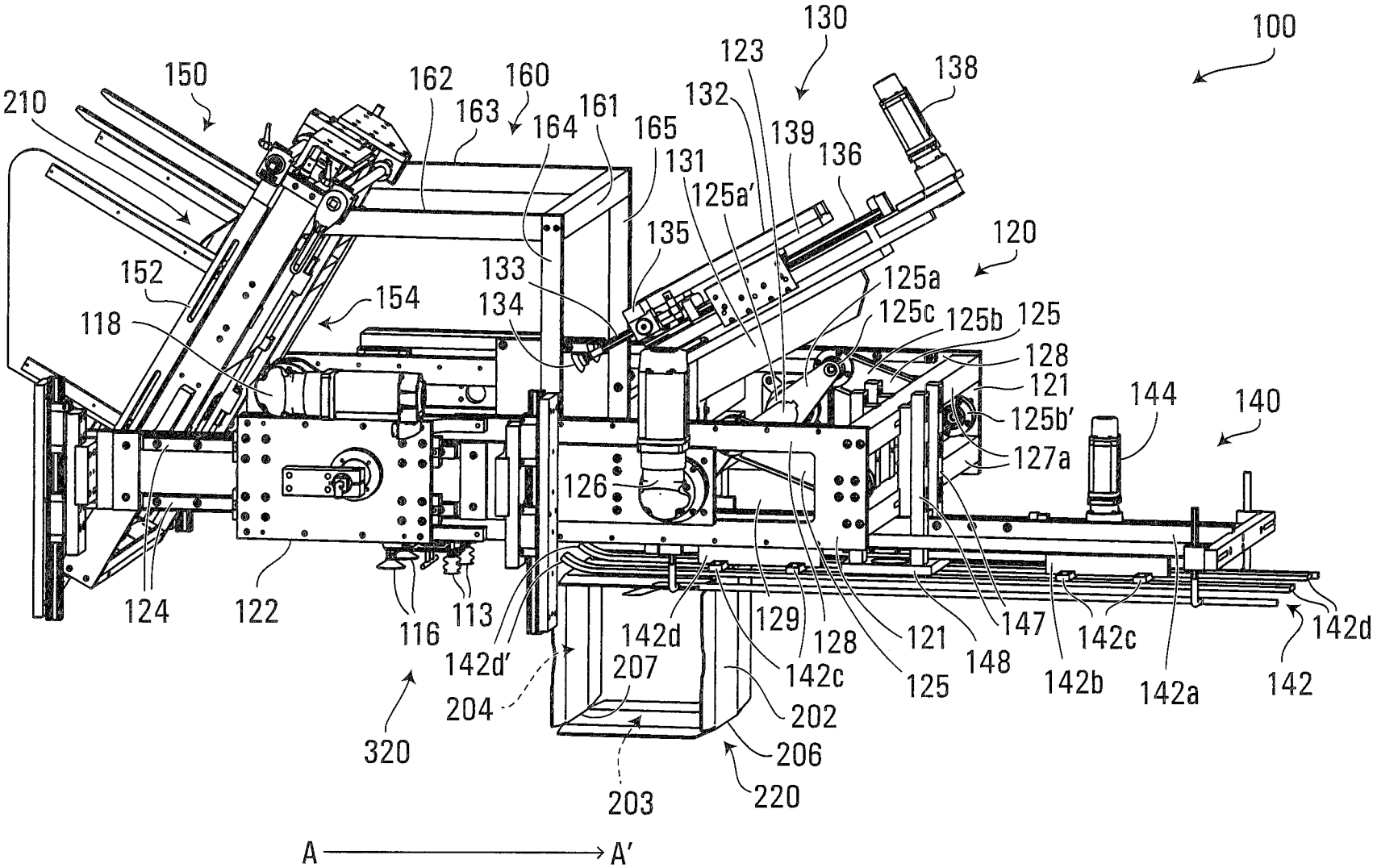
FIG. 13 is a perspective view of the carton feeder of FIG. 1B showing the carton having been conveyed away from the release location, and showing the hold-down apparatus having returned to a retracted position.
Figure 14:
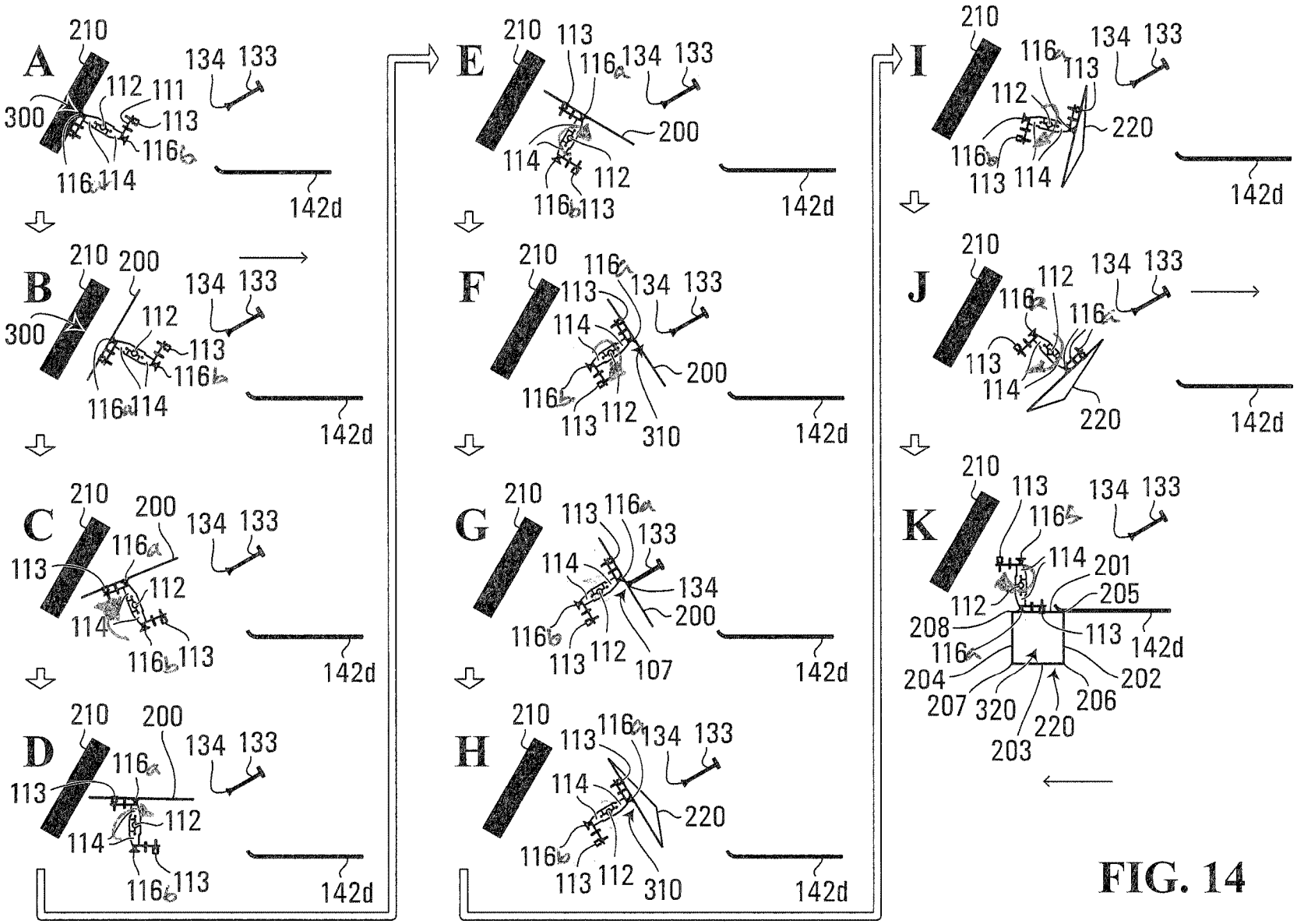
FIG. 14 is a series of schematic diagrams showing the sequence of movements of components of the carton feeder of FIG. 1B in retrieving, erecting and releasing a KD blank/carton.

Referring now to FIG. 13, hold-down apparatus 140 may be returned to its retracted position by PLC 109 operating servo drive motor 144 in such a manner to drive belt 146 and the corresponding carriage 145 on rail 141 in the opposite direction. Off-loaded carton 220 may move along a path which parallels that taken by hold-down member 142*d* as hold down apparatus 140 retracts. The movement of released carton 220 may be provided by conveyor 105 (FIG. 1A) and released carton 220 may continue down-stream for further processing. Rotary transfer apparatus 110 may then be operated under the control of PLC 109 to rotate to return engagement elements 116*a* to the retrieval location of FIGS. 6 and 14(A), and by translational movement of slide assembly 121 by the operation of servo drive motor 126 under control of PLC 109 such that slide apparatus 120 returns its retracted position and by further rotation of rotary transfer apparatus 110.

Although not shown in FIG. 14, the two sets of engagement elements members 116*a* and 116*b*—each set at 180 degrees opposite to the other—are in the embodiment of FIGS. 1 to 13 operating at the same time to process blanks—but operating 180 degrees out of phase with each other.

It may be appreciated then that between position I and position J of FIG. 14, the rotary transfer apparatus 110 may actually also move in translational movement towards and away from the blank holding apparatus to allow the opposite set of engagement elements 116*b* to retrieve a separate blank from the magazine, but this is not shown in FIG. 14.

Also, not shown is the movement of the hold down members 142*d* which would also move between positions C and E in FIG. 14, to hold down an erected carton held by the opposite set of engagement elements 116*b* (i.e. opposite to engagement elements 116*a* that would at that time be moving with the illustrated carton between the magazine and the pre-break device in FIG. 14).

It will be appreciated by those skilled in the art that changes could be made to the various aspects of the subject application described above without departing from the inventive concept thereof. It is to be understood, therefore, that this subject application is not limited to the particular aspects disclosed, but it is intended to cover modifications as defined by the appended claims.

When introducing elements of the present disclosure or the embodiments thereof, the articles "a," "an," "the," and "said" are intended to mean that there are one or more of the elements. The terms "comprising," "including," and "having" are intended to be inclusive and mean that there may be additional elements other than the listed elements.

The invention claimed is:

1. An apparatus comprising:

a magazine for containing a plurality of flattened tubular container blanks;

a rotary apparatus operable to rotate an engagement device along a cyclical rotational path between an on-loading location where the engagement device engages a blank from the plurality of flattened tubular container blanks, an operation location where the blank is at least partially erected into a container, and an off-loading location where the engagement device releases the container; and a slide apparatus comprising a slide assembly on which the rotary apparatus is mounted, the slide apparatus operable to translate the rotary apparatus from a first translational position where said engagement device can engage a blank, to a second translational position away from the magazine to allow the engagement element to traverse the rotational path without causing the blank to contact the plurality of flattened tubular container blanks, and then after the container is released, to translate the rotary apparatus back to the first translational position.

2. An apparatus as claimed in claim 1 wherein said rotary apparatus is mounted on said slide apparatus for sliding reciprocating movement.

3. An apparatus as claimed in claim 2, wherein the slide apparatus comprises a slide frame assembly, a drive shaft, a motor for driving the drive shaft, and a linkage member which connects the slide frame assembly to the drive shaft.

4. An apparatus as claimed in claim 3, wherein the slide apparatus is configured such that rotation of the drive shaft translates the slide frame assembly and the rotary member connected thereto.

5. The apparatus of claim 4, wherein said motor comprises a servo drive motor operable to drive rotation of the drive shaft.

6. An apparatus as claimed in claim 1, wherein the rotary apparatus is cantilever mounted to the slide apparatus.

7. An apparatus as claimed in claim 1, wherein the engagement device comprises at least one suction cup.

8. The apparatus as claimed in claim 1, further comprising a carton opening apparatus for at least partially erecting the container blank at the operation location.

9. An apparatus as claimed in claim 1 wherein said apparatus further comprises a hold-down apparatus connected to said movement apparatus for movement with said movement apparatus.

10. An apparatus as claimed in claim 9 wherein the hold-down apparatus comprises a hold-down member operable for movement to engage the blank at the off-loading location to maintain the container in the off-loading location during disengagement by said engagement device of said rotary apparatus.

11. An apparatus as claimed in claim 10, wherein the hold-down apparatus further comprises a hold-down rail on which the hold down member moves.

12. The apparatus of claim 11, wherein the hold-down apparatus further comprises a motor operable to drive the movement of the hold-down member.

13. An apparatus as claimed in claim 1 further comprising a controller operable to control the operation of the apparatus.

14. A method of retrieving a flat blank from a plurality of flat blanks comprising:

rotating an engagement device of a rotary apparatus along a rotational path to a first retrieval position, said rotary apparatus further comprising a rotatable shaft to which the engagement device is inter-connected;

at said first retrieval location, retrieving a flat blank from the plurality of flat blanks with the engagement device;

translating the rotary apparatus including the rotatable shaft and the engagement device with the engaged blank away from the plurality of blanks;

rotating the rotary apparatus including the rotatable shaft and the engagement device with the engaged blank to a second operational position.

15. A method as claimed in claim 14 wherein the moving of the rotary apparatus including the engagement device with the engaged blank away from the plurality of blanks occurs prior to rotating the rotary apparatus including the engagement device with the engaged blank to a second operational location.

16. A method as claimed in claim 14 wherein the rotary apparatus is moved away from the plurality of blanks in non-rotational movement, and wherein the blank is at least partially reconfigured at the second operational location.

17. A method of erecting a flattened tubular container blank into a container, the method comprising:

(a) retrieving a blank from a plurality of flattened tubular container blanks, at an on-loading position, by engaging the blank with an engagement device which is connected to a rotary member which is mounted on a slide frame;

(b) translating the slide frame to bring the rotary member, the engagement device and the blank a distance away from the plurality of flattened tubular container blanks;

(c) rotating the rotary member to bring the blank into an operation location and at least partially erecting the blank into a container; and (d) releasing the container from the engagement device at an off-loading location.

* * * * *